US007909108B2

(12) United States Patent
Swor et al.

(10) Patent No.: US 7,909,108 B2
(45) Date of Patent: Mar. 22, 2011

(54) SYSTEM AND METHOD FOR SERVICING A WELLBORE

(75) Inventors: Loren C. Swor, Duncan, OK (US); Donald R. Smith, Wilson, OK (US); Robert P. Clayton, Comanche, OK (US); Alton L. Branch, Comanche, OK (US); Jeffrey A. Jordan, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 186 days.

(21) Appl. No.: 12/418,506

(22) Filed: Apr. 3, 2009

(65) Prior Publication Data

US 2010/0252280 A1 Oct. 7, 2010

(51) Int. Cl.
*E21B 23/08* (2006.01)

(52) U.S. Cl. ..... 166/383

(58) Field of Classification Search ..... 166/383, 166/154, 318, 332.4

See application file for complete search history.

(56) References Cited

U.S. PATENT DOCUMENTS

| | | | | |
|---|---|---|---|---|
| 2,703,316 | A | 3/1955 | Schneider | |
| 3,912,692 | A | 10/1975 | Casey et al. | |
| 4,387,769 | A | 6/1983 | Erbstoesser et al. | |
| 5,216,050 | A | 6/1993 | Sinclair | |
| 6,006,838 | A * | 12/1999 | Whiteley et al. | 166/306 |
| 6,244,567 | B1 | 6/2001 | Robbins | |
| 6,323,307 | B1 | 11/2001 | Bigg et al. | |
| 6,763,892 | B2 | 7/2004 | Kaszuba | |
| 6,923,255 | B2 | 8/2005 | Lee | |
| 6,966,380 | B2 * | 11/2005 | McLoughlin et al. | 166/320 |
| 7,093,664 | B2 | 8/2006 | Todd et al. | |
| 7,108,067 | B2 * | 9/2006 | Themig et al. | 166/317 |
| 7,150,326 | B2 | 12/2006 | Bishop et al. | |
| 7,228,914 | B2 | 6/2007 | Chavers et al. | |
| 7,287,596 | B2 * | 10/2007 | Frazier et al. | 166/332.8 |
| 7,322,417 | B2 * | 1/2008 | Rytlewski et al. | 166/313 |
| 7,325,617 | B2 | 2/2008 | Murray | |
| 7,377,321 | B2 * | 5/2008 | Rytlewski | 166/313 |
| 7,387,165 | B2 * | 6/2008 | Lopez de Cardenas et al. | 166/313 |
| 7,431,091 | B2 * | 10/2008 | Themig et al. | 166/317 |

(Continued)

FOREIGN PATENT DOCUMENTS

WO 2008106639 A2 9/2008

(Continued)

OTHER PUBLICATIONS

Foreign Communication from a related counterpart application—International Search Report and Written Opinion, PCT/GB2010/000506, Oct. 4, 2010, 12 pages.

*Primary Examiner* — David J Bagnell
*Assistant Examiner* — Sonya Bible
(74) *Attorney, Agent, or Firm* — John W. Wustenberg; Conley Rose, P.C.

(57) ABSTRACT

A wellbore servicing system, comprising a plurality of sleeve systems disposed in a wellbore, each sleeve system comprising a seat and a dart configured to selectively seal against the seat to the exclusion of other seats, the seats each comprising an upper seat landing surface and the darts each comprising a dart landing surface, wherein the darts each comprise a dart landing surface that is configured to complement an upper seat landing surface of the seat to which the dart is configured to selectively seal against.

21 Claims, 30 Drawing Sheets

U.S. PATENT DOCUMENTS

| | | | | |
|---|---|---|---|---|
| 7,478,676 | B2 | 1/2009 | East, Jr. et al. | |
| 7,503,392 | B2 | 3/2009 | King et al. | |
| 7,543,634 | B2 * | 6/2009 | Fehr et al. | 166/191 |
| 7,552,779 | B2 | 6/2009 | Murray | |
| 7,575,062 | B2 * | 8/2009 | East, Jr. | 166/386 |
| 7,628,213 | B2 * | 12/2009 | Telfer | 166/381 |
| 7,748,460 | B2 * | 7/2010 | Themig et al. | 166/317 |
| 2004/0118564 | A1 * | 6/2004 | Themig et al. | 166/305.1 |
| 2006/0124310 | A1 * | 6/2006 | Lopez de Cardenas et al. | 166/313 |
| 2006/0124317 | A1 * | 6/2006 | Telfer | 166/381 |
| 2007/0007007 | A1 * | 1/2007 | Themig et al. | 166/250.17 |
| 2007/0107908 | A1 | 5/2007 | Vaidya et al. | |
| 2008/0000697 | A1 | 1/2008 | Rytlewski | |
| 2008/0135248 | A1 | 6/2008 | Talley et al. | |
| 2008/0296012 | A1 | 12/2008 | Peer et al. | |
| 2008/0302538 | A1 * | 12/2008 | Hofman | 166/373 |
| 2009/0008083 | A1 * | 1/2009 | Themig et al. | 166/185 |

FOREIGN PATENT DOCUMENTS

| | | | |
|---|---|---|---|
| WO | 2010112810 | A2 | 10/2010 |

* cited by examiner

SYSTEM AND METHOD FOR SERVICING A WELLBORE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Subterranean formations that contain hydrocarbons are sometimes non-homogeneous in their composition along the length of wellbores that extend into such formations. It is sometimes desirable to treat and/or otherwise manage the formation and/or the wellbore differently in response to the differing formation composition. Some wellbore servicing systems and method allow such treatment and may refer to such treatments as zonal isolation treatments. However, some wellbore servicing systems and methods are limited in the number of different zones that may be treated within a wellbore. Accordingly, there exists a need for improved systems and method of treating multiple zones of a wellbore.

SUMMARY

Disclosed herein is a wellbore servicing system, comprising a first sleeve system disposed in a wellbore, the first sleeve system comprising a first seat landing surface, a second sleeve system disposed in the wellbore and uphole of the first sleeve system, the second sleeve system comprising a second seat landing surface, wherein the first seat landing surface and the second seat landing surface are each at least partially frusto-conical in shape, and wherein a first seat landing surface angle of the first seat landing surface is less than a second seat landing surface angle of the second seat landing surface. In an alternative embodiment, a first seat landing surface angle of the first seat landing surface may be about equal to a second seat landing surface angle of the second seat landing surface. In further embodiments, the landing seat angles may be about constant and/or may vary across a plurality of sleeve systems disposed in the wellbore. At least one of the first seat and the second seat may be configured to sealingly engage a dart. The dart may comprise a dart outer diameter smaller than a second seat passage diameter of the second seat, and the dart outer diameter may be larger than a first seat passage diameter of the first seat. The dart may comprise a dart landing seat angle smaller than the second seat landing surface angle, and the dart landing seat angle may be substantially the same as the first seat landing surface angle. The dart may be substantially symmetrical along a dart central axis. The dart may comprise one or more alignment features. The alignment feature may be a rounded nose tip. The rounded nose tip may comprise a radius of curvature of at least about 0.5 inches. The rounded nose tip may comprise a substantially cylindrical extension joined to a substantially spherical section. The alignment feature may be a dart centralizer. The dart centralizer may comprise foam. The dart centralizer may be received on a nose of the dart. The alignment feature may be a substantially cylindrical shelf of the dart that is smaller in diameter than the dart outer diameter. The alignment feature may be a plurality of substantially cylindrical shelves having different diameters, the plurality of substantially cylindrical shelves being disposed on the dart with an increasing order of diameter from a distal end of the dart toward a center of the dart. The alignment feature may be a substantially cylindrical shelf of the dart that is smaller in diameter than the dart outer diameter and wherein the cylindrical shelf comprises a chamfered edge near a distal end of the shelf. At least a portion of at least one of the first seat, the second seat, and the dart may comprise a degradable material. At least one of the first seat and the second seat may comprise cast iron, and at least a portion of the dart that contacts the first seat landing surface may comprise cast iron. The dart comprises cast iron and a material relatively more easily degradable than cast iron. A dart body that seals against the first seat landing surface may comprise cast iron, and a dart nose of the dart may comprise a material relatively more easily degradable than cast iron. The dart, the seat, or both may be comprised of a composite material. The dart, the seat, or both may be formed as a single unitary structure. At least one of the first seat and the second seat may be frangible. The at least one frangible seat may be configured to comprise a radial array of seat pieces (e.g., sliced pie-shaped pieces). The seat pieces may be selectively held together by an epoxy resin. At least a portion of at least one of the seat pieces may be constructed of cast iron. At least a portion of at least one seat piece may be constructed of a material more easily degraded than cast iron. Such darts and seats may be removed in whole or in part by subjecting the darts and seats to degradable conditions, by reverse/back flowing the wellbore, and/or applying a mechanical force to the darts (e.g., drilling or fishing them out of the wellbore). A minimum gap may be provided between a second seat passage diameter and a dart outer diameter. The minimum gap may be within a range of about 0.030 inches and about 0.090 inches. The minimum gap may be about 0.060 inches. A minimum seal radial distance may be provided that is measured as a radial distance relative to a dart central axis over which a sealing contact interface between the first seat landing surface and a dart landing surface extends. The minimum seal radial distance may be within a range of about 0.030 inches and about 0.090 inches. The minimum seal radial distance may be about 0.060 inches.

Further disclosed herein is a method of servicing a wellbore, comprising disposing a first seat within a wellbore and disposing a second seat within the wellbore and uphole of the first seat, the first seat and the second seat comprising a first seat landing surface and a second seat landing surface, respectively, passing a first dart through a second passage of the second seat, and contacting the first dart with the first seat landing surface, wherein the first seat landing surface and second seat landing surface are at least partially frusto-conical in shape and wherein the first dart complements the first seat landing surface but does not complement the second seat landing surface. A second seat landing surface angle of the second seat landing surface may be greater than a first seat landing surface angle of the first seat landing surface. The first seat, the second seat, or both may be coupled to a sliding sleeve. A first sliding sleeve coupled to the first seat may be shifted to an open position via contact of the first seat and the first dart, thereby revealing a plurality of ports in fluid communication with a surrounding formation. The method may further comprise flowing a wellbore servicing fluid down the wellbore, through the plurality of ports, and into the surrounding formation. The wellbore servicing fluid may be a fracturing fluids and the surrounding formation may be fractured thereby. The method may further comprise degrading at least a portion of the first dart. The method may further comprise degrading at least a portion of at least one of the first seat and the second seat. The method may further comprise contacting a second dart with the second seat landing surface. The second dart may complement the second seat landing surface, and in the second dart cannot completely pass through the second passage. The method may further comprise degrading at least a portion of the second dart. The method may further comprise backflowing at least a portion of the wellbore so that any remaining portions of the first dart and any remaining portions of the second dart may be removed from contact with the first seat and the second seat, respectively.

Further disclosed herein is a wellbore servicing system, comprising a plurality of seats disposed within a work string, each successively downhole located seat comprising a smaller seat passage than the respective immediately uphole seat, the seat located furthest uphole comprising the largest seat passage amongst the plurality of seats, and a plurality of darts, each of the plurality of darts configured to sealingly engage one seat, respectively, of the plurality of seats, each dart being configured to pass through each of the plurality of seat passages located uphole of the one seat with which each dart, respectively, is configured to sealingly engage, and wherein at least one of the darts comprises an alignment feature. At least 10 seats may be disposed in a work string comprising about a 4.5 inch casing. The difference in seat passage sizes may be about 0.120 inches. A second upper seat landing surface angle of a second seat may be greater than a first upper landing surface angle of a first seat, and the first seat may be located downhole relative to the second seat. A first dart that is configured for sealing engagement with the first seat may comprise a first dart landing surface that complements the first seat but does not complement the second seat. A second dart that is configured for sealing engagement with the second seat may comprise a second dart landing surface that complements the second seat, and the second dart cannot pass through a second seat passage of the second seat. In an embodiment, at least about 20 seats may be disposed in a work string comprising about a 4.5 inch casing.

Further disclosed herein is a wellbore servicing system, comprising a plurality of sleeve systems disposed in a wellbore, each sleeve system comprising a seat and a dart configured to selectively seal against the seat to the exclusion of other seats, the seats each comprising an upper seat landing surface and the darts each comprising a dart landing surface, wherein each of the seat landing surfaces and each of the dart landing surfaces are at least partially substantially frustoconical in shape. A first seat may comprise a smaller seat landing surface angle as compared to a seat landing surface angle of a second seat that is located uphole relative to the first seat. A relatively greater number of seats may be disposed in the wellbore by configuring the seats and the darts according to a relatively smaller minimum gap required between a dart and the seats through which the dart must pass fully through. A relatively greater number of seats may be disposed in the wellbore by configuring the seats and the darts according to a relatively smaller minimum seal radial distance. At least 8 seats may be disposed in a work string comprising about a 4.5 inch casing. Alternatively, at least 10 seats may be disposed in a work string comprising about a 4.5 inch casing. Alternatively, at least 15 seats may be disposed in a work string comprising about a 4.5 inch casing. Alternatively, at least 18 seats may be disposed in a work string comprising about a 4.5 inch casing. Alternatively, about 20 seats may be disposed in a work string comprising about a 4.5 inch casing. Alternatively, about 20 or more seats may be disposed in a work string comprising about a 4.5 inch casing. At least one of the darts may comprise an alignment feature. At least one of the darts and/or seats may comprise a degradable material. At least one of the seats may be frangible. At least one of the darts may be substantially symmetrical. Darts and seats that are configured to seal against each other are configured to comprise complementary dart landing surface angles and upper seal landing surface angles, respectively. Darts and seats may be configured to comprise substantially the same dart landing surface angles and upper seal landing surface angles, respectively. The dart landing surface angles and the upper seal landing surface angles for each sleeve assembly disposed in wellbore (e.g., each mating seat/dart pair) may be the same or different. For example the angles may increase, decrease, and/or stay about constant when traversing uphole and/or downhole in the wellbore. The dart landing surface angles and the upper seal landing surface angles may be equal to about 45 degrees. Alternatively, the dart landing surface angles and the upper seal landing surface angles may be less than or equal to about 45 degrees.

Further disclosed herein is a wellbore servicing system, comprising a plurality of sleeve systems disposed in a wellbore, each sleeve system comprising a seat and a dart configured to selectively seal against the seat to the exclusion of other seats, the seats each comprising an upper seat landing surface and the darts each comprising a dart landing surface, wherein the darts each comprise a dart landing surface that is configured to complement an upper seat landing surface of the seat to which the dart is configured to selectively seal against. The dart landing surface that is configured to complement an upper seat landing surface of the seat to which the dart is configured to selectively seal against may comprise a dart landing surface angle that complements an upper seat landing surface angle of the upper seat landing surface. The dart landing surface that is configured to complement an upper seat landing surface of the seat to which the dart may be at least partially configured to have a substantially frustoconical shape. A first seat of the plurality of seats may be disposed within the wellbore downhole relative to a second seat of the plurality of seats, and a first upper seat landing surface of the first seat may comprise a first upper seat landing surface angle that is smaller than a second upper seat landing surface angle of a second upper seat landing surface of the second seat. A first seat of the plurality of seats may be disposed within the wellbore downhole relative to a second seat of the plurality of seats, and a first upper seat landing surface of the first seat may comprise a first upper seat landing surface angle that is substantially equal to a second upper seat landing surface angle of a second upper seat landing surface of the second seat.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
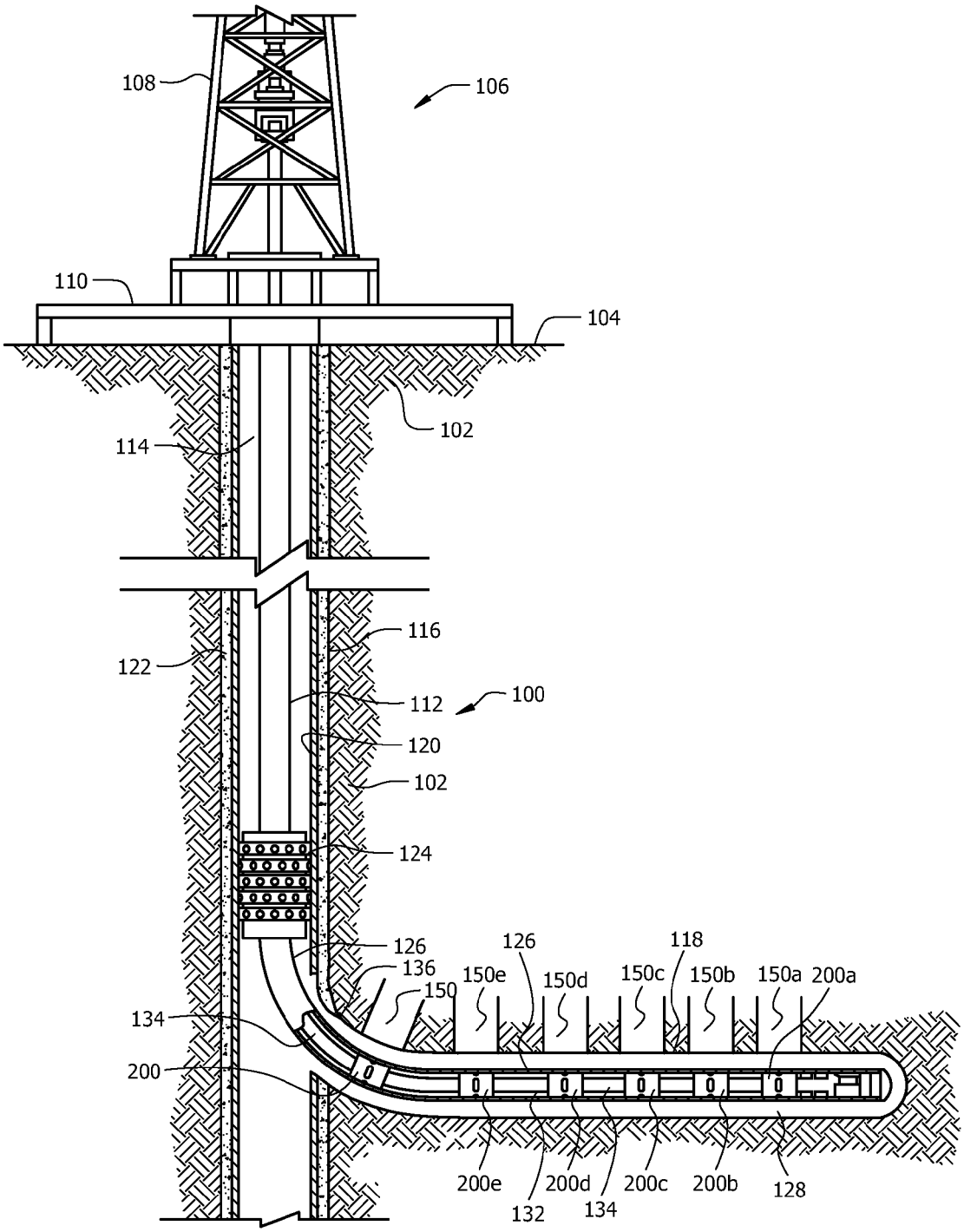
FIG. 1 is a cut-away view of an embodiment of a wellbore servicing system according to the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Referring to FIG. 1, an embodiment of a wellbore servicing system 100 is shown in an example of an operating environment. As depicted, the operating environment comprises a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique.

The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved.

At least a portion of the vertical wellbore portion 116 is lined with a casing 120 that is secured into position against the subterranean formation 102 in a conventional manner using cement 122. In alternative operating environments, a horizontal wellbore portion may be cased and cemented and/or portions of the wellbore may be uncased. The drilling rig 106 comprises a derrick 108 with a rig floor 110 through which a tubing or work string 112 (e.g., cable, wireline, E-line, Z-line, jointed pipe, coiled tubing, casing, or liner string, etc.) extends downward from the drilling rig 106 into the wellbore 114. The work string 112 delivers the wellbore servicing system 100 to a selected depth within the wellbore 114 to perform an operation such as perforating the casing 120 and/or subterranean formation 102, creating perforation tunnels and fractures (e.g., dominant fractures, micro-fractures, etc.) within the subterranean formation 102, producing hydrocarbons from the subterranean formation 102, and/or other completion operations. The drilling rig 106 comprises a motor driven winch and other associated equipment for extending the work string 112 into the wellbore 114 to position the wellbore servicing system 100 at the selected depth.

While the operating environment depicted in FIG. 1 refers to a stationary drilling rig 106 for lowering and setting the wellbore servicing system 100 within a land-based wellbore 114, in alternative embodiments, mobile workover rigs, wellbore servicing units (such as coiled tubing units), and the like may be used to lower a wellbore servicing system into a wellbore. It should be understood that a wellbore servicing system may alternatively be used in other operational environments, such as within an offshore wellbore operational environment.

The wellbore servicing system 100 comprises a liner hanger 124 (such as a Halliburton VersaFlex® liner hanger) and a tubing section 126 extending between the liner hanger 124 and a wellbore lower end. The tubing section 126 comprises a float shoe and a float collar housed therein and near the wellbore lower end. Further, a tubing conveyed device is housed within the tubing section 126 and adjacent the float collar.

The horizontal wellbore portion 118 and the tubing section 126 define an annulus 128 therebetween. The tubing section 126 comprises an interior wall that defines a flow passage 132 therethrough. An inner string 134 is disposed in the flow passage 132 and the inner string 134 extends therethrough so that an inner string lower end extends into and is received by a polished bore receptacle near the wellbore lower end.

The subterranean formation 102 comprises a deviated zone 150 associated with deviated wellbore portion 136. The subterranean formation 102 further comprises first, second, third, fourth, an fifth horizontal zones, 150*a*, 150*b*, 150*c*, 150*d*, 150*e*, respectively, associated with the horizontal wellbore portion 118. In this embodiment, the zones 150, 150*a*, 150*b*, 150*c*, 150*d*, 150*e* are offset from each other along the length of the wellbore 114 in the following order of increasingly downhole location: 150, 150*e*, 150*d*, 150*c*, 150*b*, and 150*a*. In this embodiment, stimulation and production sleeve systems 200, 200*a*, 200*b*, 200*c*, 200*d*, and 200*e* are located within wellbore 114 in the work string 112 and are associated with zones 150, 150*a*, 150*b*, 150*c*, 150*d*, and 150*e*, respectively. It will be appreciated that zone isolation devices such as annular isolation devices (e.g., annular packers and/or swellpackers) may be selectively disposed within wellbore 114 in a manner that restricts fluid communication between spaces immediately uphole and downhole of each annular isolation device.

Figure 2:
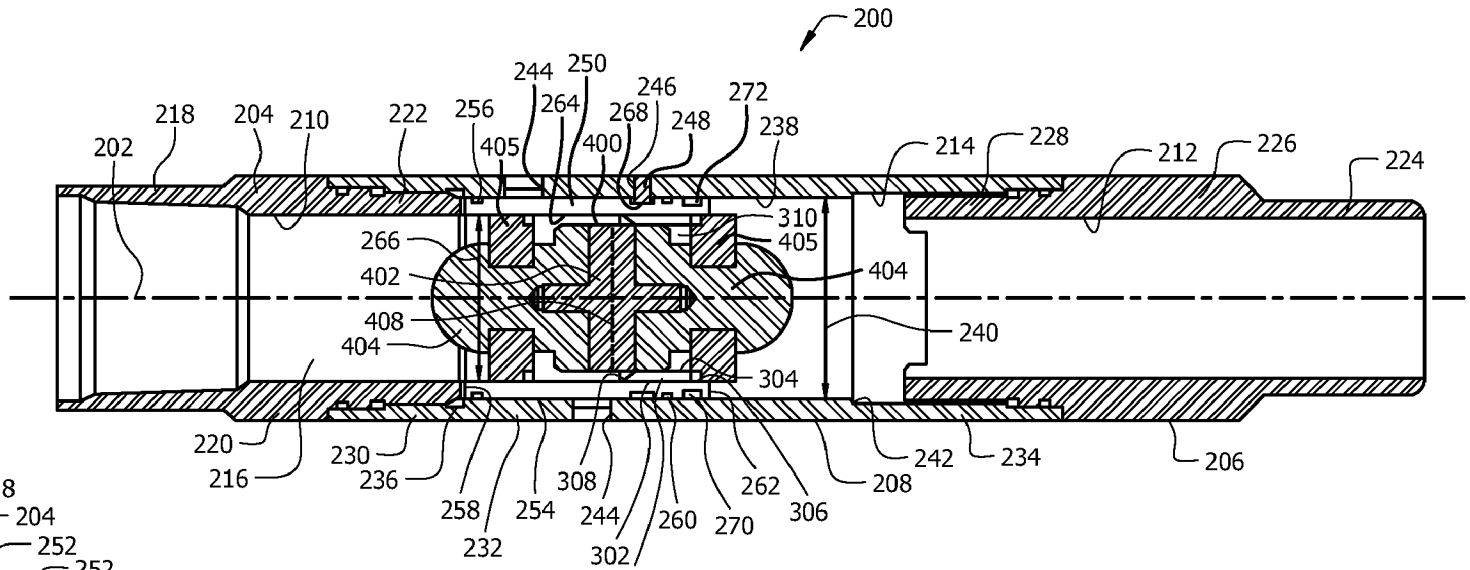
FIG. 2 is a cross-sectional view of a sleeve system of the wellbore servicing system of FIG. 1.
Figure 3:
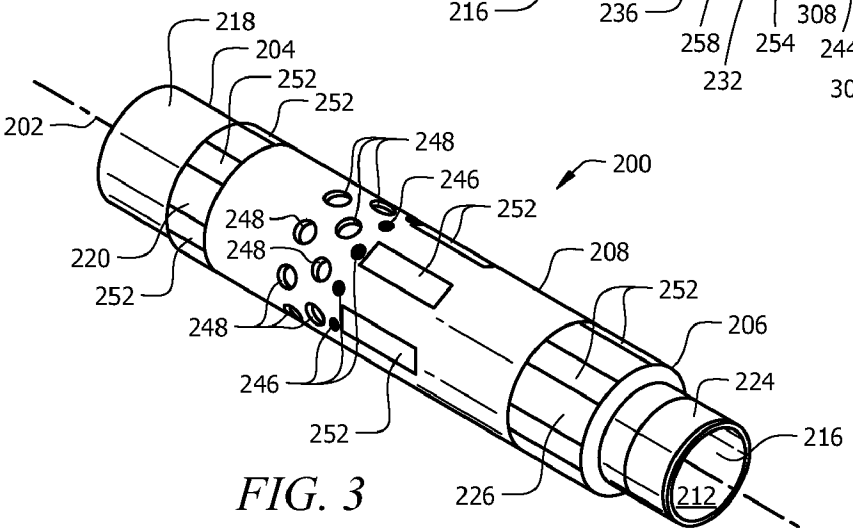
FIG. 3 is an oblique view of the sleeve system of FIG. 2.

Referring now to FIGS. 2-3, a cross-sectional view and an oblique view of an embodiment of a stimulation and production sleeve system 200 (hereinafter referred to as "sleeve system" 200) is shown, respectively. Many of the components of sleeve system 200 lie substantially coaxial with a central axis 202 of sleeve system 200. Sleeve system 200 comprises an upper adapter 204, a lower adapter 206, and a ported case 208. The ported case 208 is joined between the upper adapter 204 and the lower adapter 206. Together, inner surfaces 210, 212, 214 of the upper adapter 204, the lower adapter 206, and the ported case 208, respectively, substantially define a sleeve flow bore 216. The upper adapter 204 comprises a collar 218, a makeup portion 220, and a case interface 222. The collar 218 is internally threaded and otherwise configured for attachment to an element of work string 112 that is adjacent and uphole of sleeve system 200 while the case interface 222 comprises external threads for engaging the ported case 208. The lower adapter 206 comprises a nipple 224, a makeup portion 226, and a case interface 228. The nipple 224 is externally threaded and otherwise configured for attachment to an element of work string 112 that is adjacent and downhole of sleeve system 200 while the case interface 228 also comprises external threads for engaging the ported case 208.

The ported case 208 is substantially tubular in shape and comprises an upper adapter interface 230, a central ported body 232, and a lower adapter interface 234, each having substantially the same exterior diameters. However, the inner surface 214 of ported case 208 comprises an upper shoulder 236 that extend between a threaded interior of the upper adapter interface 230 to an inner slide surface 238 of the ported body 232. The interior of the upper adapter interface 230 is smaller in diameter relative to a diameter 240 of the inner slide surface 238. Similarly, the inner surface 214 of ported case 208 comprises a lower shoulder 242 between a threaded interior of the lower adapter interface 234 to the inner slide surface 238 of the ported body 232. The interior of the lower adapter interface 234 is smaller in diameter relative to the diameter 240 of the inner slide surface 238. The ported case 208 further comprises ports 244 and shear apertures 246. As will be explained in further detail below, ports 244 are through holes extending radially through the ported case 208 and are selectively used to provide fluid communication between sleeve flow bore 216 and a space immediately exterior to the ported case 208. Further, the shear apertures 246 accept shear screws 248 therethrough to selectively restrict movement of a baffle 250 of the sleeve system 200 with respect to the ported case 208. Each of upper adapter 204, lower adapter 206, and ported case 208 comprise flat tool landings 252 which allow rotary tools, vices, and/or other suitable equipment to grip and/or rotate the upper adapter 204, lower adapter 206, and ported case 208 relative to each other during assembly and/or disassembly of the sleeve system 200.

Baffle 250 is formed substantially as a cylindrical tube having an exterior surface 254 sized slightly smaller than the diameter 240 of inner slide surface 238. The baffle 250 further comprises an upper groove 256 located near an upper end 258 of the baffle 250 and formed in the exterior surface 254. Similarly, the baffle 250 comprises a lower groove 260 located near a lower end 262 of the baffle 250 and formed in the exterior surface 254. The upper and lower grooves 256, 260 accept sealing members that form seals between the exterior surface 254 of baffle 250 and the inner slide surface 238 of the central ported body 232. In this embodiment, the baffle 250 comprises an inner surface 264 having a diameter 266 that is substantially similar to an inner diameter of the case interface 222 of the upper adapter 204. The baffle 250 further comprises a shear groove 268 and an expansion ring groove 270.

The shear groove 268 provides a circumferential recess configured to receive shear screws 248. Accordingly, while shear screws 248 extend into both shear apertures 246 and shear groove 268, relative movement between the baffle 250 and the ported case 208 along the central axis 202 is restricted. More specifically, with the baffle 250 and the ported case 208 relatively positioned as shown in FIG. 2, the baffle 250 is restrained so that ports 244 do not provide fluid communication between sleeve flow bore 216 and a space immediately exterior to the ported case 208 via ports 244. Instead, the portions of the inner slide surface 238 adjacent the ports 244 are substantially covered by the exterior surface 254 of the baffle 250. Further, when a sealing member is disposed within the upper groove 256 of the baffle 250, any annular space between the baffle 250 and the inner slide service 238 downhole upper groove 256 is sealed from fluid communication with portions of sleeve flow bore 216 that are uphole of upper groove 256.

However, it will be appreciated that without sufficient restriction from shear screws 248, the baffle 250 may be caused to slide relative to the ported case 208 downhole along the central axis 202 toward the lower adapter 206. With sufficient downhole movement of the baffle 250 relative to the central ported body 232 of the ported case 208, fluid communication between sleeve flow bore 216 and a space immediately exterior to the ported case 208 via ports 244 may be achieved. Such fluid communication may occur when the baffle 250 is located so that a seal member carried within upper groove 256 of baffle 250 is located downhole of at least a portion of a port 244. Further, substantially unrestricted fluid communication may occur when the baffle 250 is located so that the upper end 258 of baffle 250 is located downhole of at least a portion of a port 244. Still further, substantially fully unrestricted fluid communication may occur between the sleeve flow bore 216 and a space immediately exterior to the ported case 208 via ports 244 when the upper end 258 of baffle 250 is located downhole of all ports 244. With baffle 250 moved sufficiently downhole relative to position of the baffle 250 shown in FIG. 2, the expansion ring groove 270 extends beyond the lower shoulder 242 of the ported case 208 and into the lower adapter interface 234. Such location allows radially outward expansion of an expansion ring 272 carried within expansion ring groove 270. Such expansion of the expansion ring 272 prevents subsequent uphole movement along central axis 202 of baffle 250 due to interference between the expansion ring 272 and the lower shoulder 242 of the ported case 208.

Still referring to FIG. 2-3, the sleeve system 200 further comprises a seat 300 carried by baffle 250. The seat 300 is discussed below in greater detail with reference to FIGS. 4-6. Most generally, the seat 300 is substantially tubular in shape. The seat 300 comprises an exterior surface 302, an interior surface 304, a lower seat end 306, and a seat upper landing surface 308. A portion of the exterior surface 302 of the seat 300 is threaded for engagement with a similarly threaded portion of the inner surface 264 of the baffle 250. Further, the seat 300 is sized and shaped so that seat upper landing surface 308 restricts passage of a dart 400 through a seat passage 310. The dart 400 is discussed below in greater detail with reference to FIGS. 7-12. The dart 400 comprises a dart body 402 and two noses 404 attached to dart body 402 so that dart 400 is substantially symmetrical along the central axis 202. As will be explained below in greater detail, dart body 402 of dart 400 can be caused to seal against at least the seat upper landing surface 308 of seat 300, thereby contributing to the above mentioned downhole movement of baffle 250. In other words, the dart 400 can be caused to act against the seat 300, thereby moving the baffle 250 from the position shown in FIG. 2 to allow fluid communication between the sleeve flow bore 216 and a space immediately exterior to the ported case 208 via ports 244.

Figure 4:
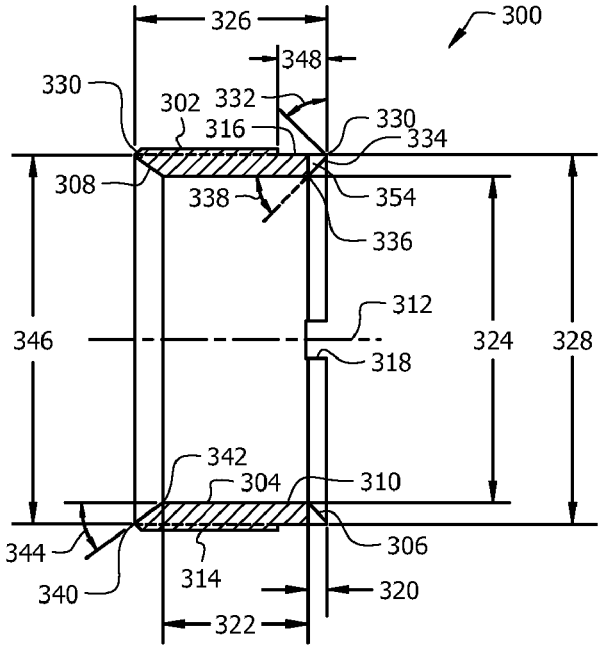
FIG. 4 is a cross-sectional view of a seat of the sleeve system of FIG. 2.
Figure 5:
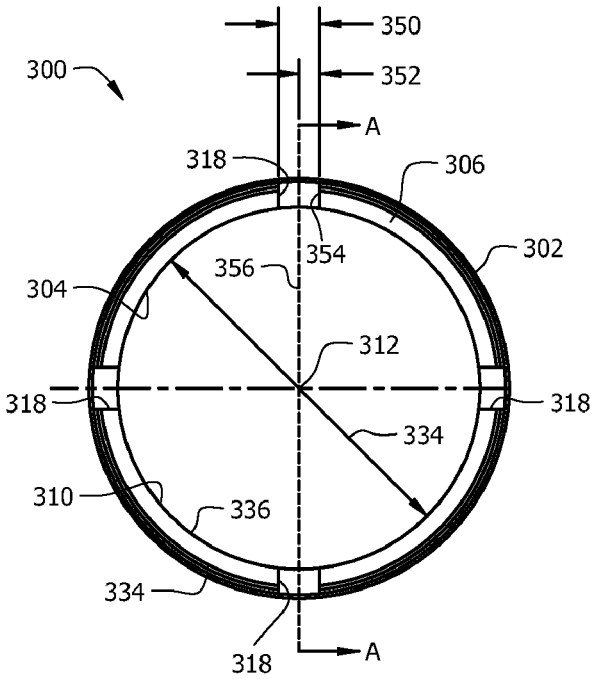
FIG. 5 is an orthogonal end view of the seat of FIG. 4.
Figure 6:
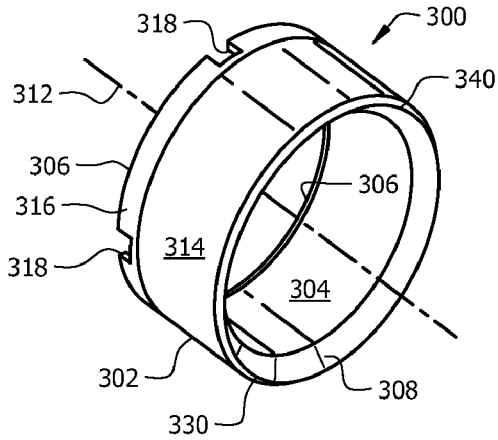
FIG. 6 is an oblique view of the seat of FIG. 4.

Referring now to FIGS. 4-6, seat 300 is shown in greater detail. Seat 300 further comprises a seat central axis 312 that, when installed with baffle 250 is substantially coaxial with the central axis 202 of sleeve system 200. The exterior surface 302 comprises a baffle interface surface 314 that is threaded for engagement with inner surface 264 of baffle 250. The exterior surface 302 further comprises a tool interface surface 316 having a tool interface surface length 348 that extends between the baffle interface surface 314 and the lower seat end 306. The seat 300 further comprises tool notches 318 that extend from the lower seat end 306 toward the seat upper landing surface 308. The tool notches 318 comprise a tool notch depth 320, a tool notch width 350, and a tool notch bisection length 352. The tool notch bisection length 352 represents the distance between a first notch side 354 and a bisection plane 356 that substantially bisects seat 300 in FIG. 5. The tool notches 318 accept portions of tools used to rotate the seat 300 about the central axis 312 and/or to restrict rotation of seat 300 about central axis 312 relative to the baffle 250 to allow assembly/disassembly of the seat 300 to the baffle 250. Further, the interior surface 304 comprises an interior surface length 322 and an interior surface diameter 324. The exterior surface 302 comprises an exterior surface length 326 and exterior surface diameter 328. The exterior surface 302 is joined to each of the lower seat end 306 and the seat upper landing surface 308 by chamfers 330 each having a chamfer angle 332. The lower seat end 306 is substantially formed as a frusto-conical surface having a lower seat end base 334, lower seat end truncated tip 336, and a lower seat end angle 338. The lower seat end angle 338 is measured relative to the central axis 312. Similarly, the seat upper landing surface 308 is substantially formed as a frusto-conical surface having a seat upper landing surface base 340, a seat upper landing surface truncated tip 342, and a seat upper landing surface angle 344. The seat upper landing surface angle 344 is also measured relative to the central axis 312. The seat upper landing surface base has a base diameter 346. In this embodiment, seat 300 is sized and otherwise configured to complement dart 400.

Figure 7:
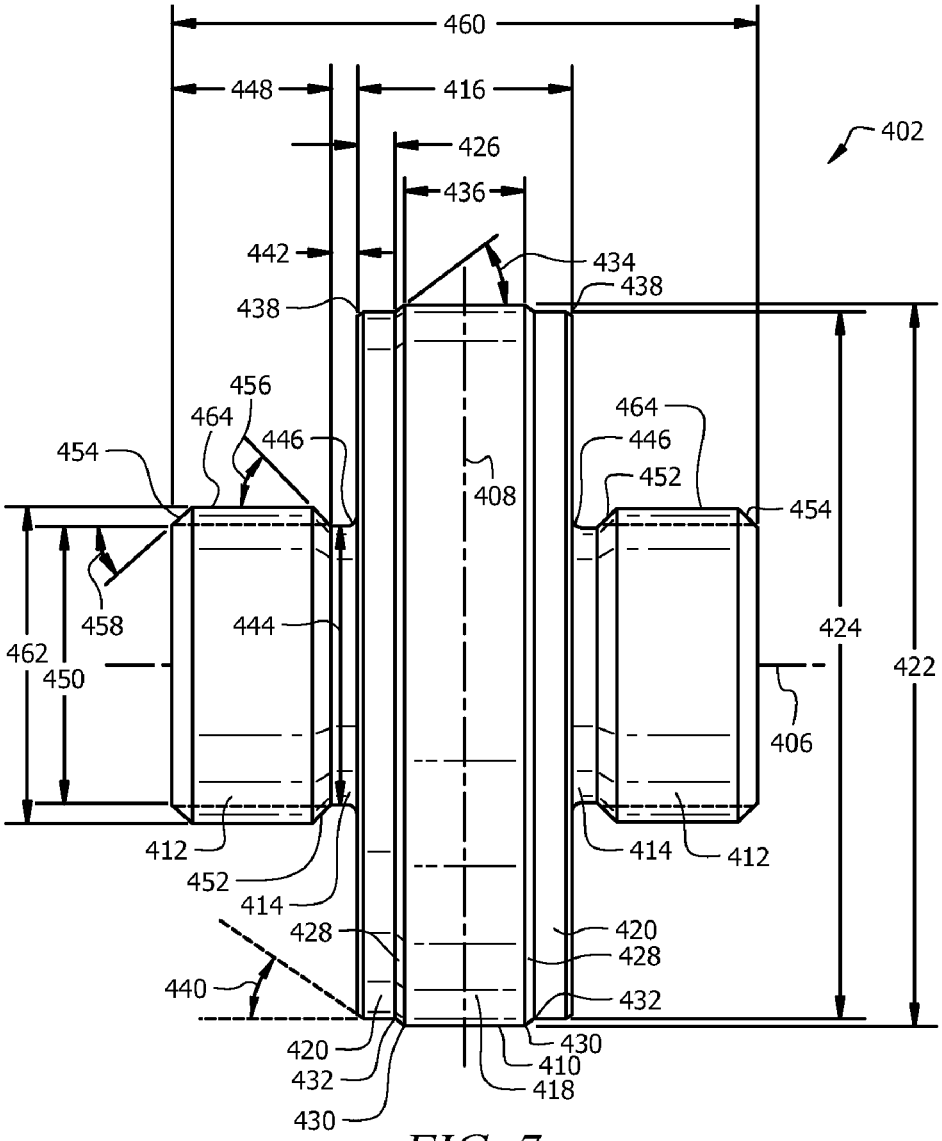
FIG. 7 is an orthogonal side view of a dart body of a dart of the sleeve system of FIG. 2.
Figure 8:
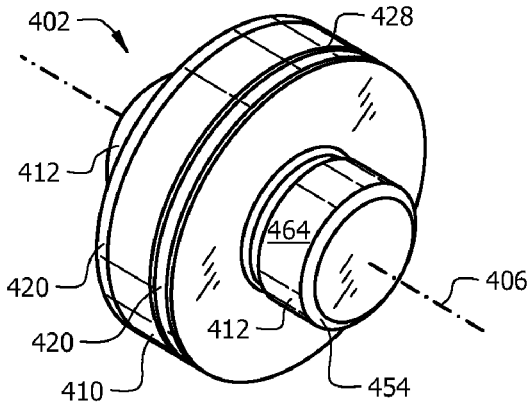
FIG. 8 is an oblique view of the dart body of FIG. 7.

Referring now to FIGS. 7-8, the dart body 402 is shown in greater detail. The dart body 402 is generally symmetrical along a dart central axis 406. When dart 400 is seated against seat 300 as shown in FIG. 2, dart central axis 406 is substantially coaxial with central axis 312 of seat 300 and is substantially coaxial with central axis 202 of sleeve system 200. Dart 400 symmetry is generally made with reference to dart bisection plane 408 which is substantially normal to dart central axis 406. Accordingly, dart body 402 is likewise substantially symmetrical in the above-described manner. Dart body 402 generally comprises a central disc 410 joined between two body arms 412 along the dart central axis 406 by body necks 414. Central disc 410 comprises a central disc length 416 along the dart central axis 406. The central disc 410 further comprises a central ring 418 joined along the dart central axis 400 between two central shelves 420. The central ring 418 comprises a central ring diameter 422 while each of the central shelves 420 comprise smaller central shelf diameters 424.

The central shelves 420 each comprise a central shelf length 426 along the dart central axis 406 while the central ring comprises a central ring length 436 along the dart central axis 406. Still further, the central ring 418 comprises two dart landing seats 428 that provide a transition between central ring 418 and central shelves 420. More specifically, each dart landing seat 428 is formed substantially as a frusto-conical surface having a dart landing seat base 430, a dart landing seat truncated tip 432, and a dart landing seat angle 434. The dart landing seat angle 434 is measured relative to the dart central axis 406. Further, the dart landing seat bases 430 are adjacent to the central ring 418 while the dart landing seat truncated tips 432 are adjacent the central shelves 420. Still further, central shelves 420 comprise chamfers 438, each having a central shelf a chamfer angle 440.

Body necks 414 are substantially disc shaped, lie substantially coaxial with dart central axis 406, and abut against opposing lengthwise sides of central disc 410. Each body neck 414 comprises a body neck length 442 and a body neck diameter 444. Body necks 414 are joined to central disc 410 with rounded transitions 446, each having substantially the same radius of curvature. Further, body necks 414 are abutted between the central ring 418 and body arms 412. Body arms 412 are also substantially disc shaped and lie substantially coaxial with dart central axis 406. Each body arm 412 comprises a body arm length 448 along the dart central axis 406, a body arm minor diameter 450, and a body arm major diameter 462. Each body arm 412 also comprises an inner chamfer 452 and an outer chamfer 454. The inner chamfers 452 comprise inner chamfer angles 456 while the outer chamfers 454 comprise outer chamfer angles 458. Body arm threaded portions 464 extend between the inner chamfers 452 and outer chamfers 454. It will be appreciated that the entire dart body 402 comprises a dart body length 460 along the dart central axis 406. In this embodiment, the central ring diameter 422 represents the largest radial extension of dart body 402 from dart central axis 406 while the central shelf diameter 424 is slightly smaller than the central ring diameter 422. Further, in this embodiment, the body neck diameter 444 is substantially the same as body arm minor diameter 450 while body arm major diameter 462 is slightly larger than body arm minor diameter 450.

Figure 9:
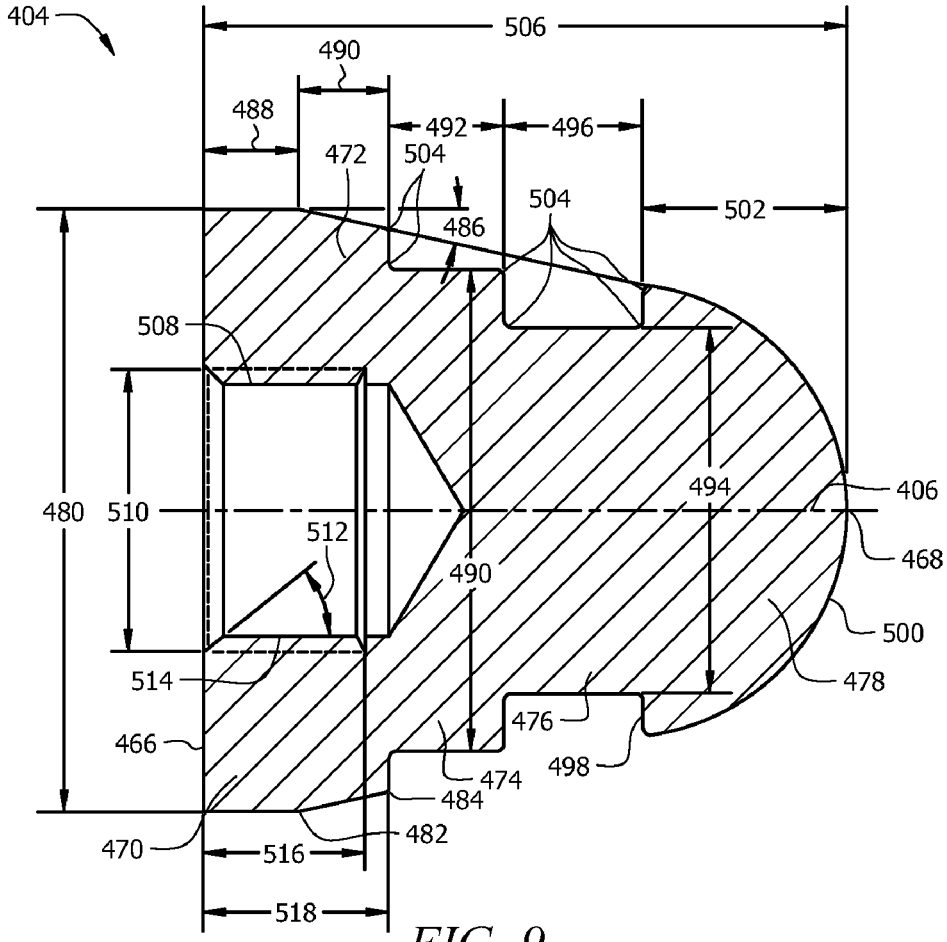
FIG. 9 is a cross-sectional view of a dart nose of a dart of the sleeve system of FIG. 2.
Figure 10:
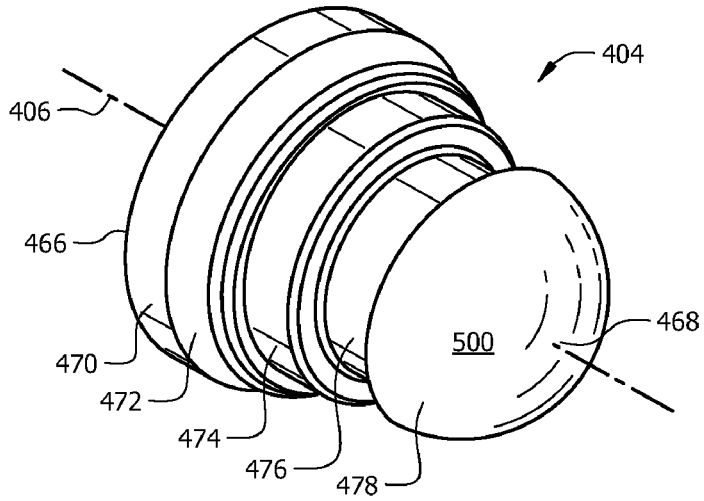
FIG. 10 is an oblique view of the dart nose of FIG. 9.

Referring now to FIGS. 9-10, a dart nose 404 is shown in greater detail. Dart nose 404 comprises a dart nose base end 466 and the dart nose tip end 468. Dart nose 404 further comprises a dart nose base 470, a dart nose transition 472, a dart nose shelf 474, a dart nose centralizer support 476, and a dart nose tip 478 disposed successively along the dart central axis 406. The dart nose base 470 is substantially disc shaped and has a dart nose base diameter 480 and a dart nose base length 488 along the dart central axis 406. The dart nose transition 472 is substantially frusto-conical in shape and comprises a nose transition base 482 adjacent the dart nose transition 472, a nose transition truncated tip 484, and a nose transition angle 486. The nose transition angle 486 is measured relative to the dart central axis 406. Further, the dart nose transition 472 has a transition length 490 along the dart central axis 406. The dart nose shelf 474 is substantially disc shaped and lies adjacent dart nose transition 472 at nose transition truncated tip 484. The dart nose shelf 474 comprises a dart nose shelf diameter 490 and a dart nose shelf length 492. The dart nose centralizer support 476 is also substantially disc shaped and lies adjacent dart nose shelf 474. The dart nose centralizer support 476 comprises a centralizer support diameter 494 and a centralizer support length 496. Further, the dart nose tip 478 lies adjacent the dart nose centralizer support 476 and is substantially formed as a spherical section. The dart nose tip 478 comprises a substantially flat section base 498 and a rounded surface 500. The dart nose tip 478 further comprises a spherical section radius of curvature and a dart nose tip length 502. Still further, dart nose 404 comprises rounded transitions 504 each having a rounded transition radius of curvature. Dart nose 404 further comprises a dart nose length 506 that extends between dart nose base end 466 and dart nose tip end 468. While geometry of the dart nose base 470, the dart nose transition 472, the dart nose shelf 474, the dart nose centralizer support 476, and the dart nose tip 478 are individually explained above, it will be appreciated that, in this embodiment, each of the components of the dart nose 404 are integrally formed. Dart nose 404 further comprises a countersunk hole 508 that lies substantially coaxial with the dart central axis 406 and extends into the dart nose 404 from the dart nose base end 466. The countersunk hole 508 comprises a countersink major diameter 510 and countersink angle 512. A countersunk hole inner wall 514 is threaded over a substantial portion of a threaded length 516. The countersunk hole 508 further comprises a countersunk hole length 518.

Figure 11:
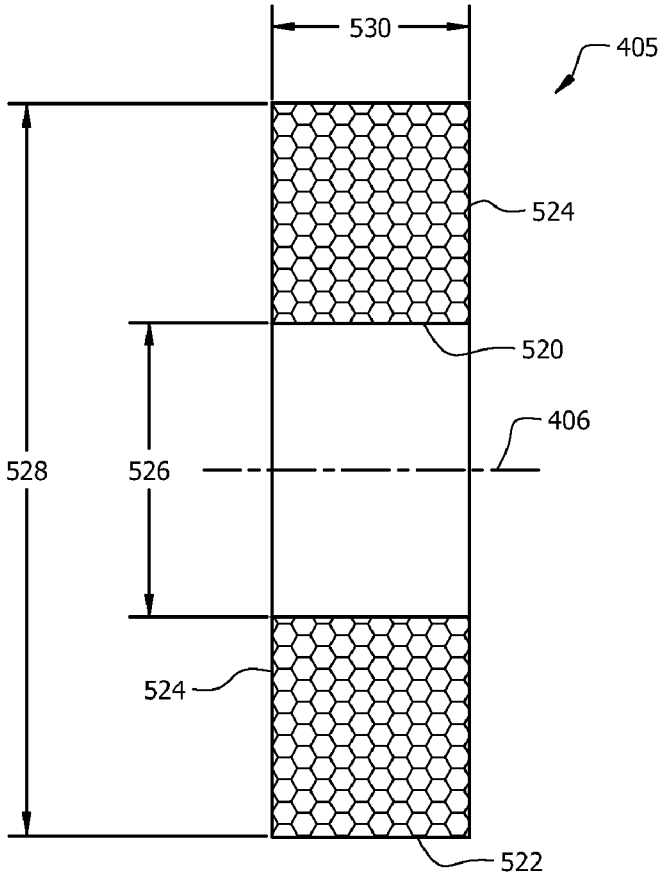
FIG. 11 is a cross-sectional view of a dart centralizer of a dart of the sleeve system of FIG. 2.
Figure 12:
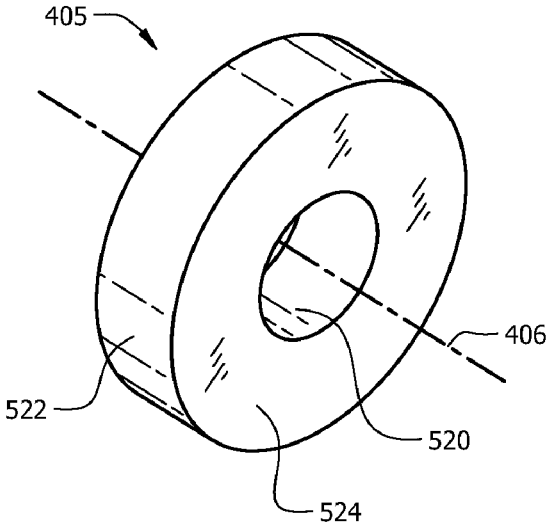
FIG. 12 is an oblique view of the dart centralizer of FIG. 11.

Referring now to FIGS. 11-12, a dart centralizer 405 is shown in greater detail. Dart centralizer 405 is substantially shaped as a cylindrical annular ring. Dart centralizer 405 comprises an inner centralizer surface 520, an outer centralizer surface 522, and substantially parallel centralizer ends 524. The dart centralizer 405 further comprises a centralizer inner diameter 526, a centralizer outer diameter 528, and a centralizer length 530.

Referring now to FIGS. 2 and 7-11, dart 400 may be assembled in the manner described below. Assembly of dart 400 may begin first by aligning both the dart body 402 and one dart nose 404 along the dart central axis 406 so that a dart body 402 and the dart nose 404 are offset from each other with dart nose tip end 468 located furthest from the dart body 402. Next, the dart body 402 and the dart nose 404 may be moved toward each other along the dart central axis 406 until a body arm 412 of dart body 402 contacts the dart nose 404 in the countersunk hole 508. Next, dart body 402 and the dart nose 404 may be rotated relative to each other about the dart central axis 406 so that threads of the body arm threaded portion 464 increasingly engage the threads of the countersunk hole 508 along a threaded length 516. Such relative rotation is continued until dart nose base end 466 contacts central disc 410. Another dart nose 404 may be assembled to the remaining body arm 412 of the same dart body 402 in substantially the same manner described above. Finally, dart centralizers 405 may be assembled to dart noses 404, one each respectively, by passing dart nose tip 478 within the centralizer inner diameter 526 along the centralizer length 530. Dart centralizer 405 is moved toward dart nose base end 466 until the opposing centralizer ends 524 are substantially carried between dart nose tip 478 and dart nose shelf 474. In this embodiment, the centralizer inner diameter 526 is substantially similar to the centralizer support diameter 494. Further, in this embodiment, the centralizer length 530 is substantially similar to the centralizer support length 496. In a manner described above, dart 400 is assembled so that dart 400 is substantially symmetrical along the dart central axis 406.

It will be appreciated that sleeve system **200*b* is substantially similar in form and function to sleeve system 200. However, seat 300*b* and dart 400*b* each comprise differences from seat 300 and dart 400. Accordingly, this detailed discussion will not address every dimensional difference and/or similarity between shared features, but rather, will focus on some of the notable differences amongst the components. For ease of reference, features that are substantially similar between seat 300 and seat 300***b* and dart 400 and dart 400*b* are denoted with like numerical references but different alphabetical references. Most generally, seat 300*b* comprises a smaller passage 310*b* as compared to passage 310 and dart 400*b* comprises a smaller central ring diameter 422*b* as compared to central ring diameter 422. With reference to FIG. 1, it will be appreciated that dart 400*b* is generally sufficiently smaller than dart 400 so that dart 400*b* may be flowed entirely through seat 300 of sleeve system 200. However, dart 400*b* is sized relative to seat 300*b* so that dart 400*b* cannot pass through seat 300*b*. Instead, dart 400*b* is sized to form a seal between dart landing seat 428*b* and seat upper landing surface 308*b* in a substantially similar manner as dart 400 seals against seat 300. The components of sleeve system 200*b* are shown in greater detail FIGS. 13-23.

Figure 13:
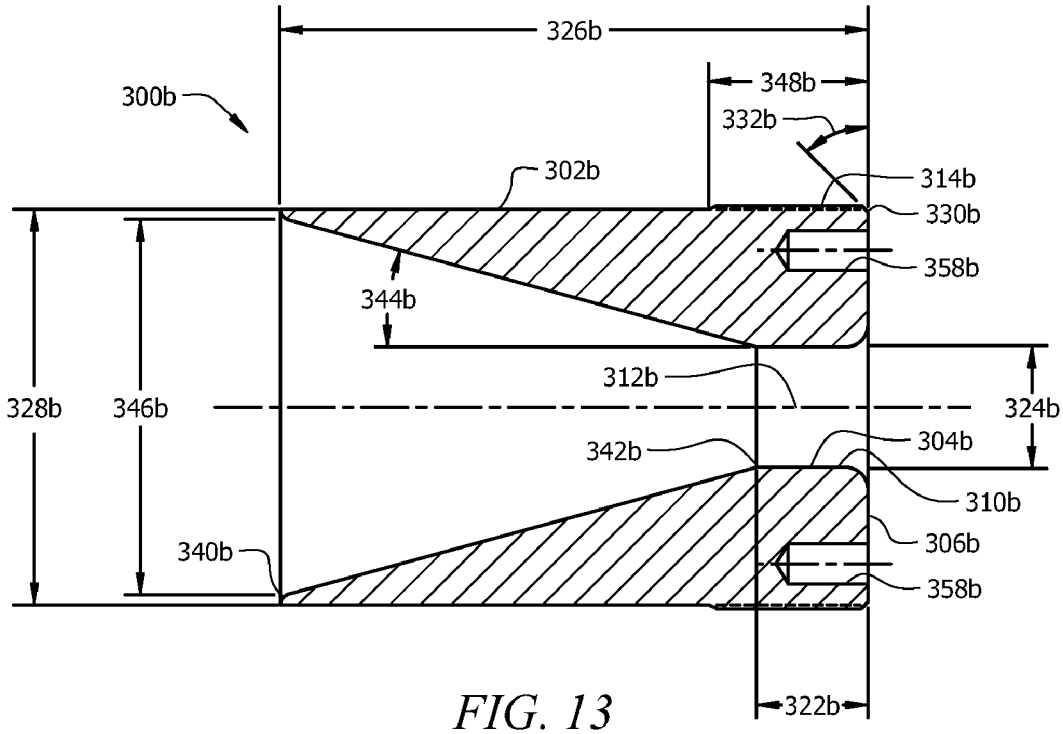
FIG. 13 is a cross-sectional view of a seat of another embodiment of a sleeve system of the wellbore servicing system of FIG. 1.
Figure 14:
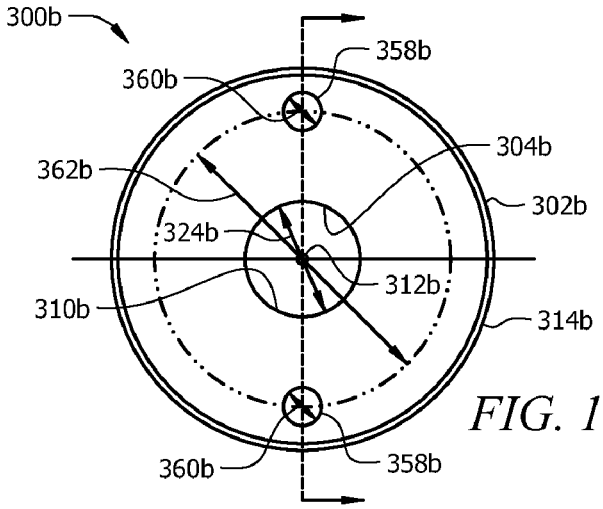
FIG. 14 is an orthogonal end view of the seat of FIG. 13.
Figure 15:
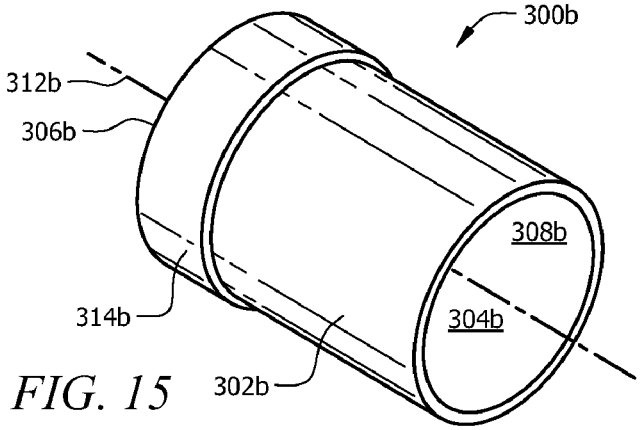
FIG. 15 is an oblique view of the seat of FIG. 13.

Seat 300*b* is shown in FIGS. 13-15. A first difference between seat 300*b* and seat 300 is that lower seat end 306*b* is not a frusto-conical surface, but rather, is substantially flat an orthogonal to central axis 312*b*. Further, lower seat end 306*b* does not comprise tool notches, but rather, comprises tool holes 358*b* that extend from the lower seat end 306*b* substantially parallel to central axis 312*b*. The tool holes 358*b* each have a tool hole diameter 360*b* and are disposed in a radial array about the central axis 312*b* along a tool hole pattern diameter 362*b*. Also, the exterior surface length 326*b* is substantially longer than the exterior surface length 326. However, the interior surface length 322*b* associated with the passage 310*b* is substantially smaller in proportion to the exterior surface length 326*b* as compared to the proportion between interior surface length 322 and exterior surface length 326. Further, the interior surface diameter 324*b* is substantially less than the interior surface diameter 324. Also, the seat upper landing surface 308*b* extends substantially longer along central axis 312*b* as compared to the distance seat upper landing surface 308 extend along central axis 312. Still further, the seat upper landing surface angle 344*b* is substantially less than the seat upper landing surface angle 344. Nonetheless, the exterior surface diameter 328*b* is substantially similar to the exterior surface diameter 328, thereby encouraging interchangeability of seats within baffles 250 and, in some cases, eliminating the need for differently configured baffles 250 for use among the various seats, such as seats 300, 300*b*.

Figure 16:
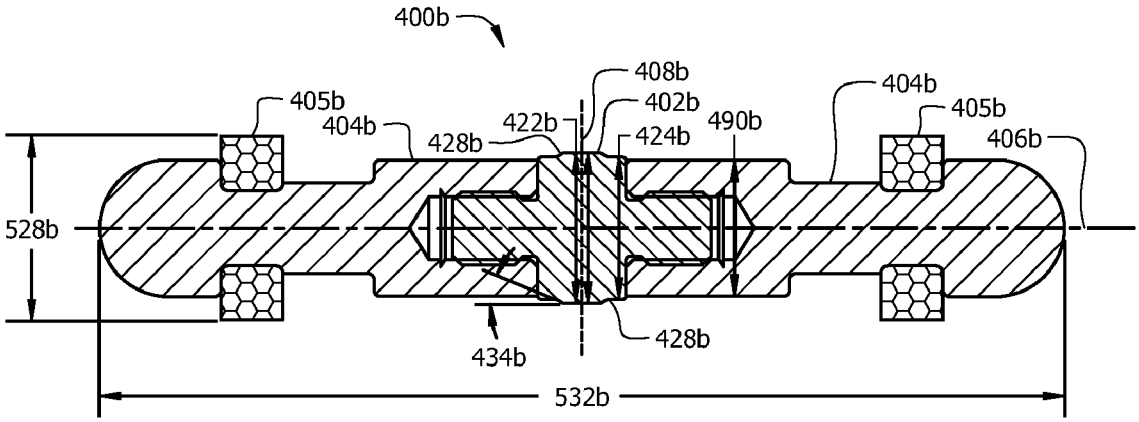
FIG. 16 is a cross-sectional view of a dart of another embodiment of a sleeve system of the wellbore servicing system of FIG. 1.
Figure 17:
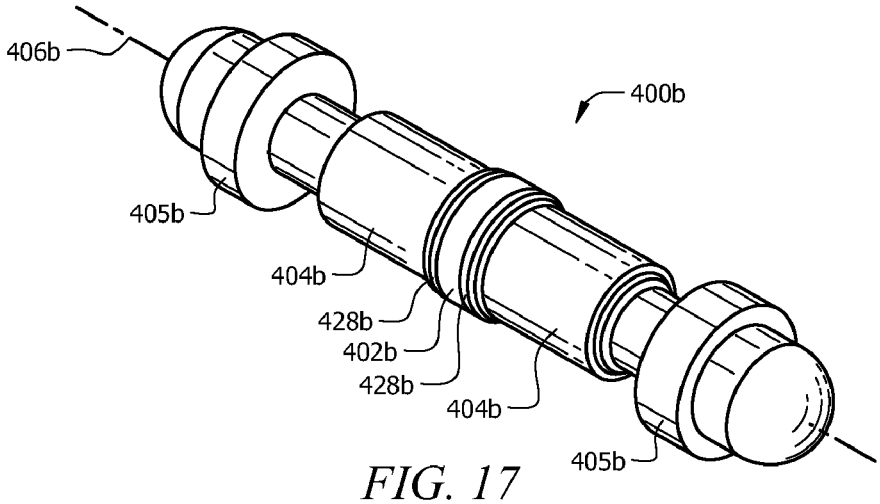
FIG. 17 is an oblique view of the dart of FIG. 16.

Dart 400*b* is shown in FIGS. 16 and 17. Like dart 400, dart 400*b* is substantially symmetrical along the length of dart central axis 406*b* and about dart bisection plane 408*b*. Also like dart 400, dart 400*b* comprises a dart body 402*b*, two dart noses 404*b*, and two dart centralizers 405*b*. Dart 400*b* is configured to interact with seat 300*b* in a substantially similar manner as dart 400 interacts with seat 300. Dart length 532*b* is less than the overall length of dart 400 and also comprises substantially smaller radial dimensions as compared to dart 400. It will be appreciated that dart 400*b* is assembled in substantially the same manner as dart 400.

Figure 18:
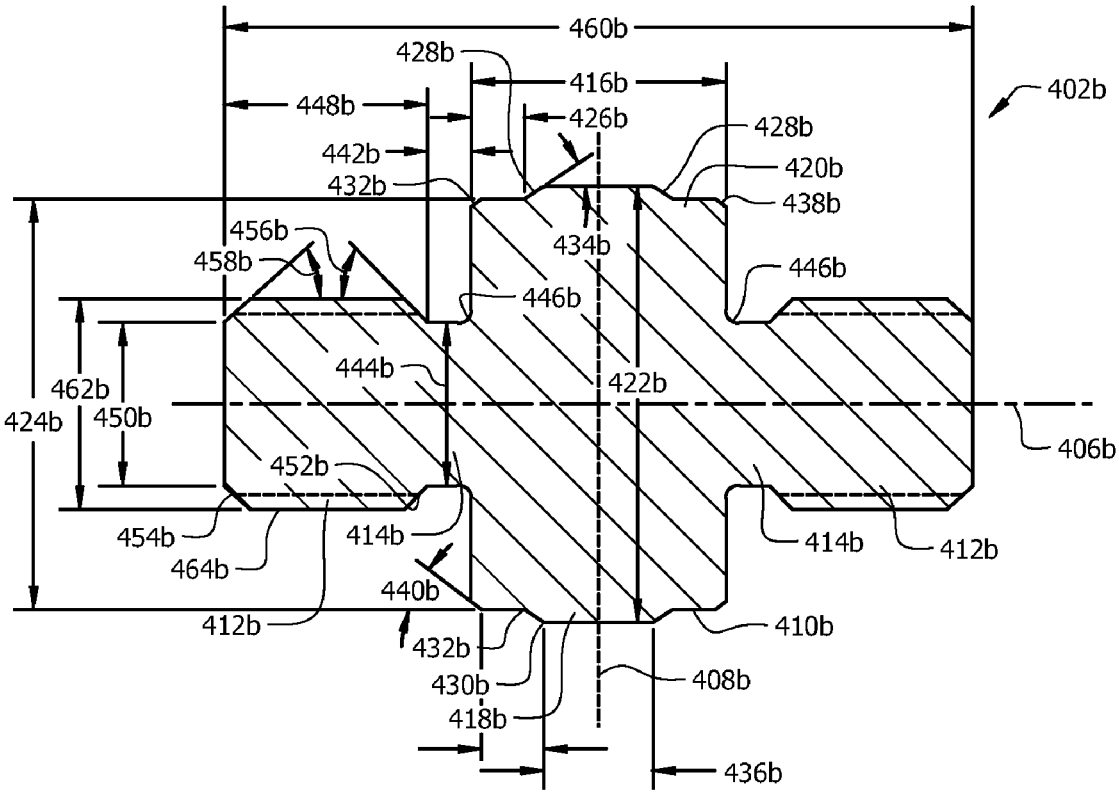
FIG. 18 is a cross-sectional view of a dart body of the dart of FIG. 16.
Figure 19:
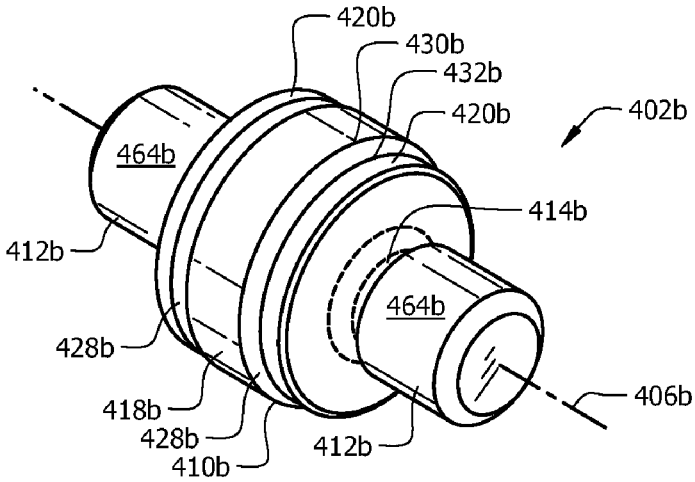
FIG. 19 is an oblique view of the dart body of FIG. 18.

Dart body 402*b* is shown in FIGS. 18 and 19. Dart body 402*b* is substantially similar to dart body 402 in form and function. However, dart body 402*b* is appropriately sized for interaction with seat 300*b* rather than seat 300. More specifically, dart landing seat angle 434*b* comprises a relatively more acute angle as compared to dart landing seat angle 434. Further, central ring diameter 422*b* is substantially smaller than central ring diameter 422 so that dart body 402*b* may pass through seat 300. However, central ring diameter 422*b* is not so small as to be able to pass through seat 300*b*.

Figure 20:
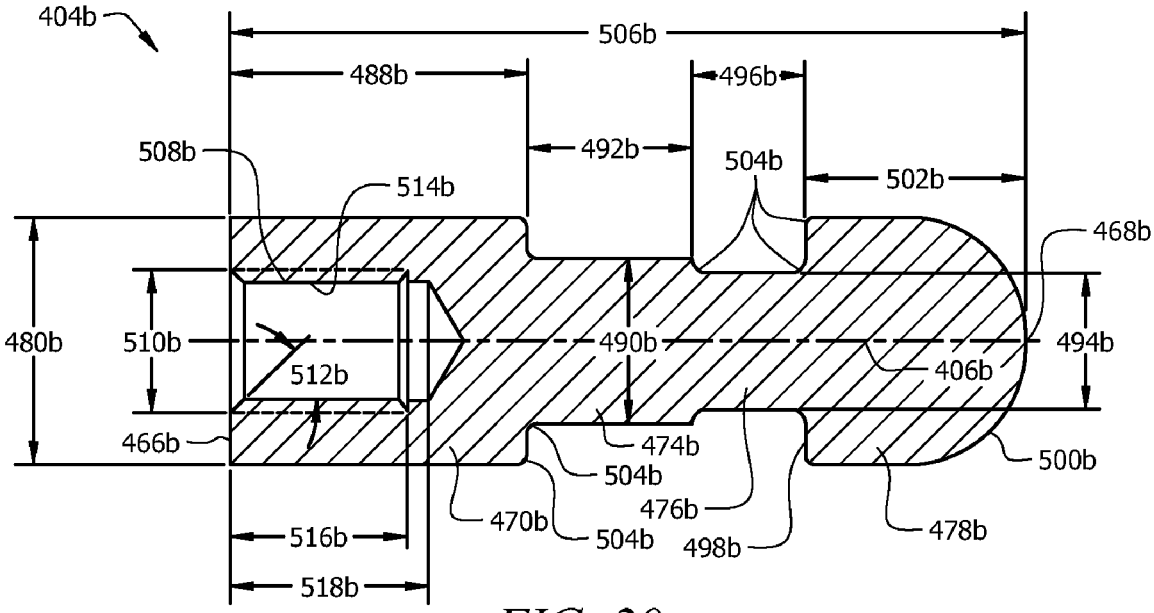
FIG. 20 is a cross-sectional view of a dart nose of the dart of FIG. 16.
Figure 21:
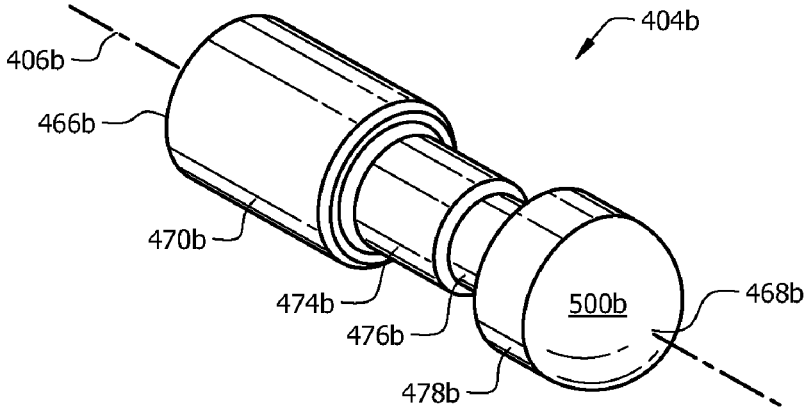
FIG. 21 is an oblique view of the dart nose of FIG. 20.

Dart nose 404*b* is shown in FIGS. 20 and 21. Dart nose 404*b* comprises many substantial similarities with dart nose 404. However, dart nose 404*b* does not comprise a dart nose transition such as dart nose transition 472, but rather, dart nose shelf 474*b* directly abuts dart nose base 470*b*. Further, dart nose tip 478*b* comprises a substantially cylindrical portion extending from the rounded surface 500*b* rather than being shaped substantially as a spherical section like dart nose tip 478. Still further, the radius of curvature of the rounded surface 500*b* is substantially smaller than the radius of curvature of the rounded surface 500.

Figure 22:
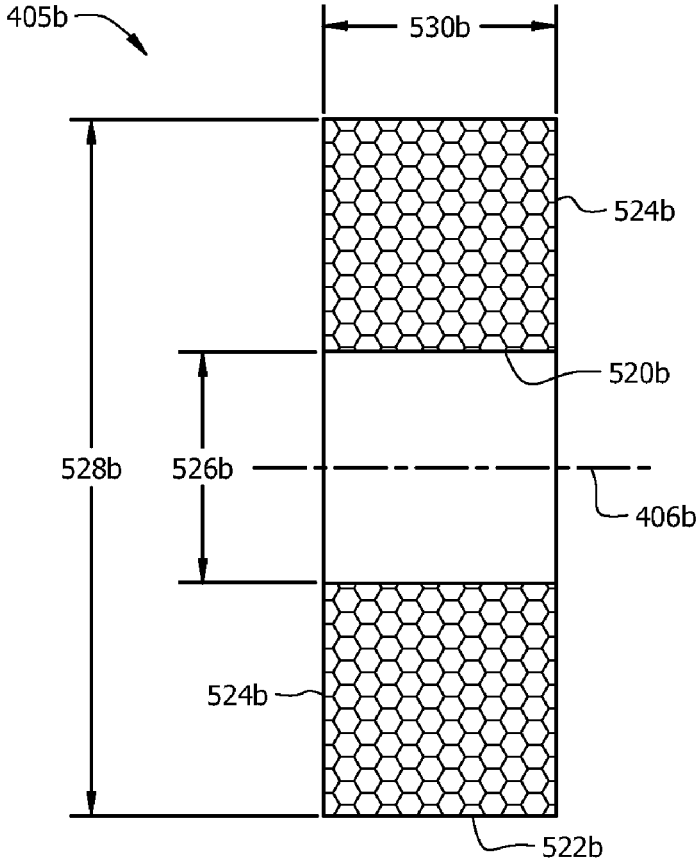
FIG. 22 is a cross-sectional view of a dart centralizer of the dart of FIG. 16.
Figure 23:
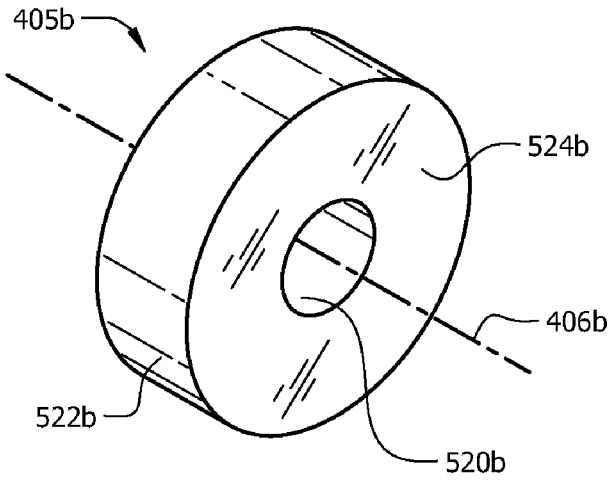
FIG. 23 is an oblique view of the dart centralizer of FIG. 22.

Dart centralizer 405*b* is shown in FIGS. 22 and 23. Dart centralizer 405*b* is substantially similar in form and function to dart centralizer 405. However, dart centralizer 405*b* is appropriately sized, generally smaller, than dart centralizer 405.

It will be appreciated that sleeve system 200*a* is substantially similar in form and function to sleeve system 200*b*. However, seat 300*a* and dart 400*a* each comprise differences from seat 300*b* and dart 400*b*. Accordingly, this detailed discussion will not address every dimensional difference and/or similarity between shared features, but rather, will focus on some of the notable differences amongst the components. For ease of reference, features that are substantially similar between seat 300*b* and seat 300*a* and dart 400*b* and dart 400*a* are denoted with like numerical references but different alphabetical references. Most generally, seat 300*a* comprises a smaller passage 310*a* as compared to passage 310*b* and dart 400*a* comprises a smaller central ring diameter 422*a* as compared to central ring diameter 422*b*. With reference to FIG. 1, it will be appreciated that dart 400*a* is generally sufficiently smaller than dart 400*b* so that dart 400*a* may be flowed entirely through seat 300*b* of sleeve system 200*b*. However, dart 400*a* is sized relative to seat 300*a* so that dart 400*a* cannot pass through seat 300*a*. Instead, dart 400*a* is sized to form a seal between dart landing seat 428*a* and seat upper landing surface 308*a* in a substantially similar manner as dart 400*b* seals against seat 300*b*. The components of sleeve system 200*a* are shown in greater detail FIGS. 24-34.

Figure 24:
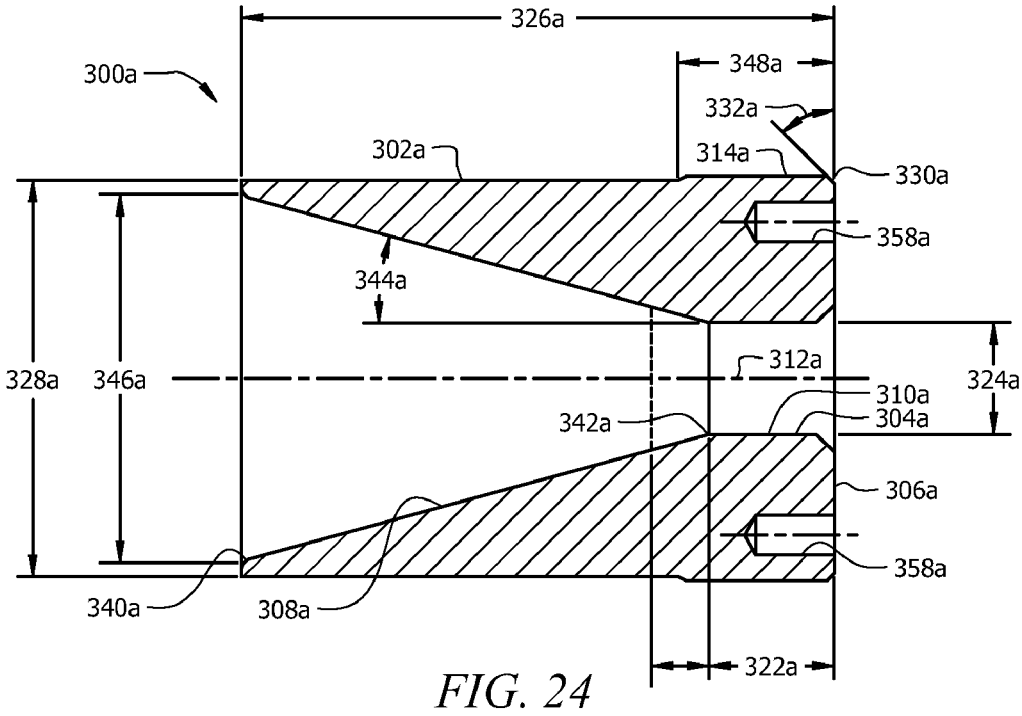
FIG. 24 is a cross-sectional view of a seat of still another embodiment of a sleeve system of the wellbore servicing system of FIG. 1.
Figure 25:
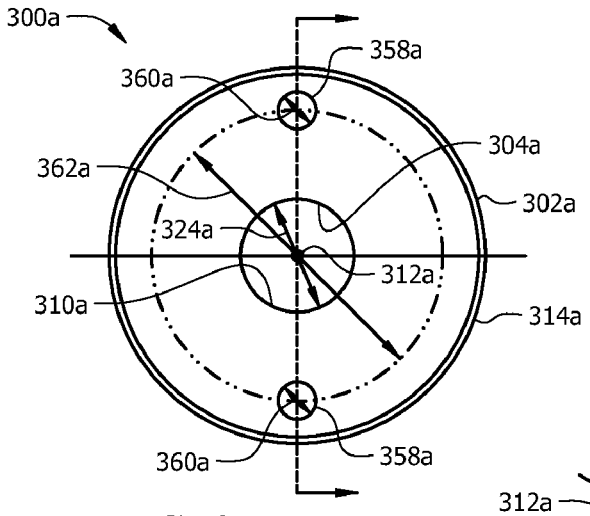
FIG. 25 is an orthogonal end view of the seat of FIG. 24.
Figure 26:
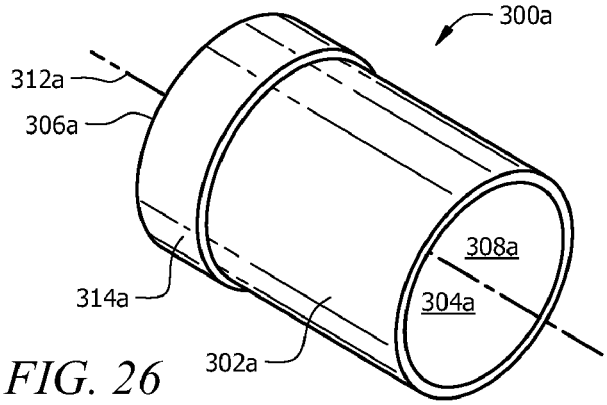
FIG. 26 is an oblique view of the seat of FIG. 24.

Seat 300*a* is shown in FIGS. 24-26. A first difference between seat 300*a* and seat 300*b* is that the exterior surface length 326*a* is longer than the exterior surface length 326*b*. Further, the interior surface length 322*a* associated with the passage 310*a* is larger in proportion to the exterior surface length 326*a* as compared to the proportion between interior surface length 322*b* and exterior surface length 326*b*. Still further, the interior surface diameter 324*a* is less than the interior surface diameter 324*b*. Also, the seat upper landing surface 308*b* extends longer along central axis 312*a* as compared to the distance seat upper landing surface 308*b* extends along central axis 312*b*. In addition, the seat upper landing surface angle 344*a* is less than the seat upper landing surface angle 344*b*. Nonetheless, the exterior surface diameter 328*a* is substantially similar to the exterior surface diameter 328*b*, thereby encouraging interchangeability of seats within baffles 250 and, in some cases, eliminating the need for differently configured baffles 250 for use among the various seats, such as seats 300*a*, 300*b*.

Figure 27:
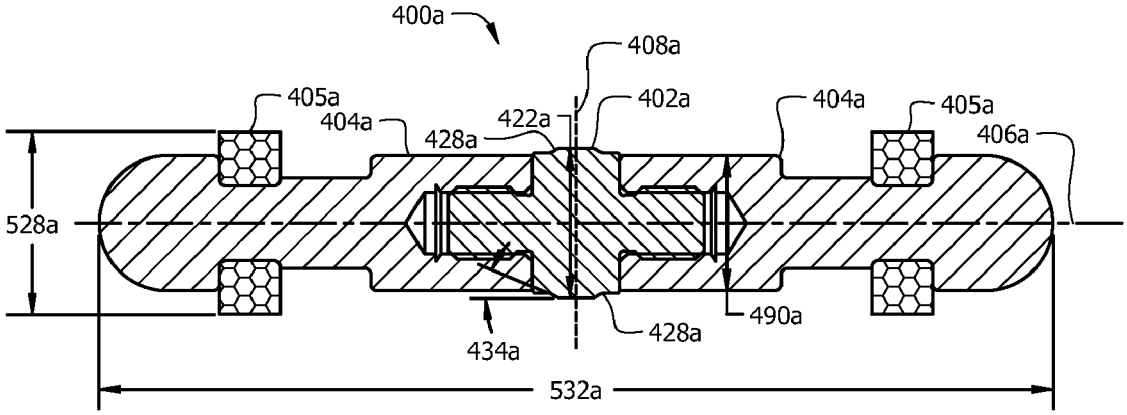
FIG. 27 is a cross-sectional view of a dart of still another embodiment of a sleeve system of the wellbore servicing system of FIG. 1.
Figure 28:
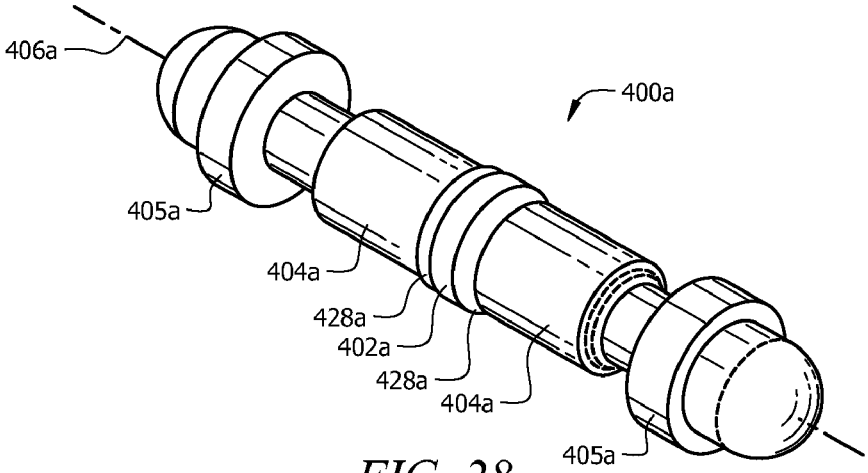
FIG. 28 is an oblique view of the dart of FIG. 27.

Dart 400*a* is shown in FIGS. 27 and 28. Like dart 400*b*, dart 400*a* is substantially symmetrical along the length of dart central axis 406*a* and about dart bisection plane 408*a*. Also like dart 400*b*, dart 400*a* comprises a dart body 402*a*, two dart noses 404*a*, and two dart centralizers 405*a*. Dart 400*a* is configured to interact with seat 300*a* in a substantially similar manner as dart 400*b* interacts with seat 300*b*. Dart length 532*a* is less than the dart length 532*b* and also generally comprises smaller radial dimensions as compared to dart 400*b*. It will be appreciated that dart 400*a* is assembled in substantially the same manner as dart 400*b*.

Figure 29:
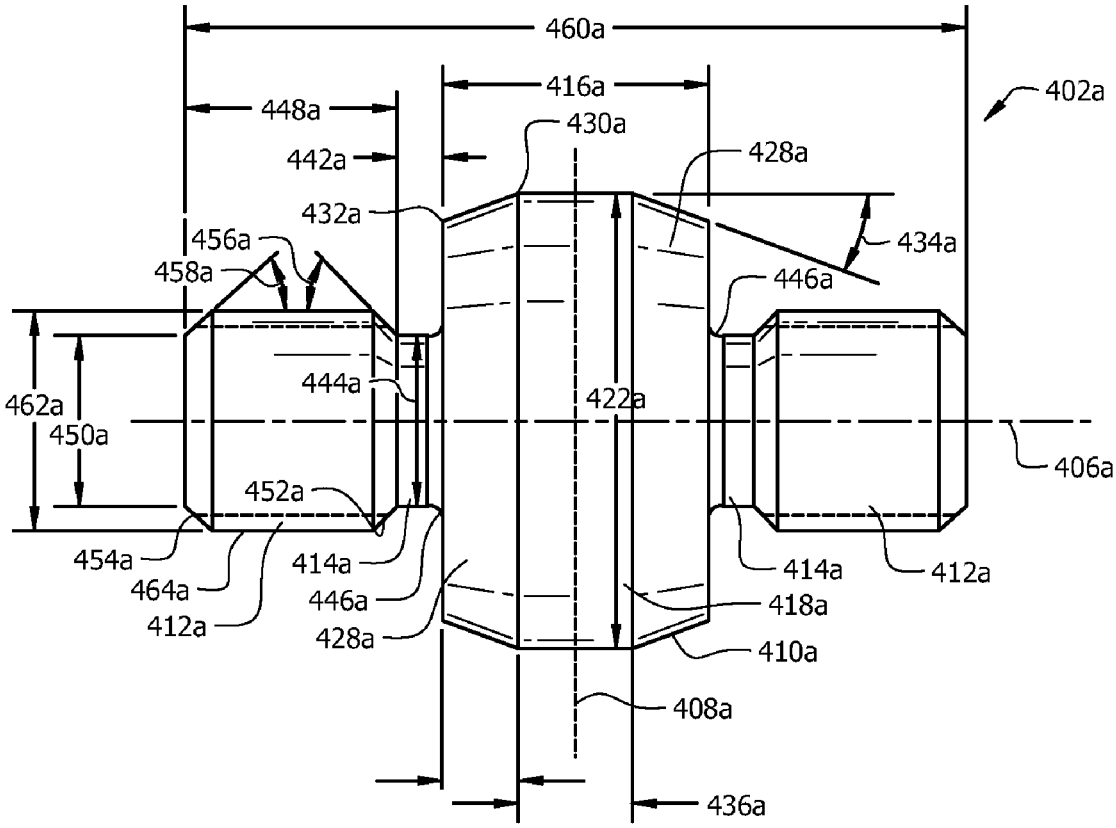
FIG. 29 is an orthogonal side view of a dart body of the dart of FIG. 27.
Figure 30:
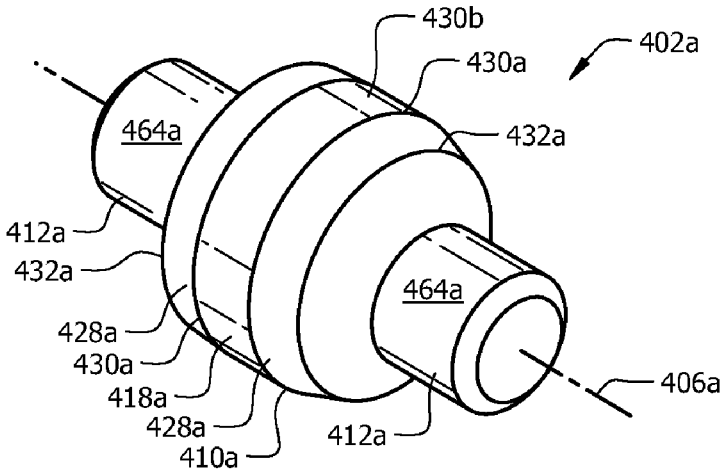
FIG. 30 is an oblique view of the dart body of FIG. 29.

Dart body 402*a* is shown in FIGS. 29 and 30. Dart body 402*a* is substantially similar to dart body 402*b* in form and function. However, dart body 402*a* is appropriately sized for interaction with seat 300*a* rather than seat 300*b*. More specifically, dart landing seat angle 434*a* comprises a relatively more acute angle as compared to dart landing seat angle 434*b*. Further, central ring diameter 422*a* is smaller than central ring diameter 422*b* so that dart body 402*a* may pass through seat 300*b*. However, central ring diameter 422*a* is not so small as to be able to pass through seat 300*a*. Further, unlike dart body 402*b*, dart body 402*a* does not comprise central shelves such as central shelves 420*b*. Instead, dart landing seats 428*a* directly abut central ring 418*a*.

Figure 31:
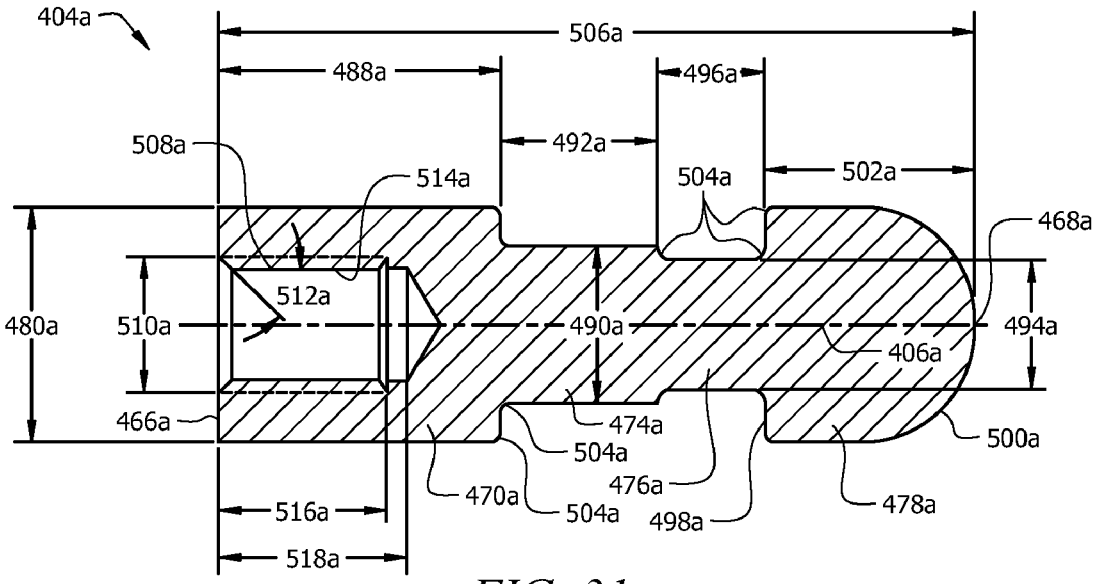
FIG. 31 is a cross-sectional view of a dart nose of the dart of FIG. 27.
Figure 32:
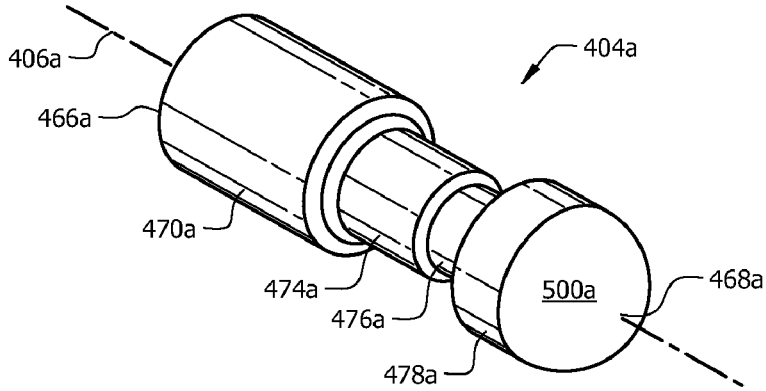
FIG. 32 is an oblique view of the dart nose of FIG. 31.

Dart nose 404*a* is shown in FIGS. 31 and 32. Dart nose 404*a* is substantially similar to dart nose 404*b*. However, dart nose base diameter 480*a* is smaller than dart nose base diameter 480*b*. Further, the radius of curvature of the rounded surface 500*a* is smaller than the radius of curvature of the rounded surface 500*b*. Also, the countersink hole major diameter 510*a* is smaller than the countersink hole major diameter 510*b*.

Figure 33:
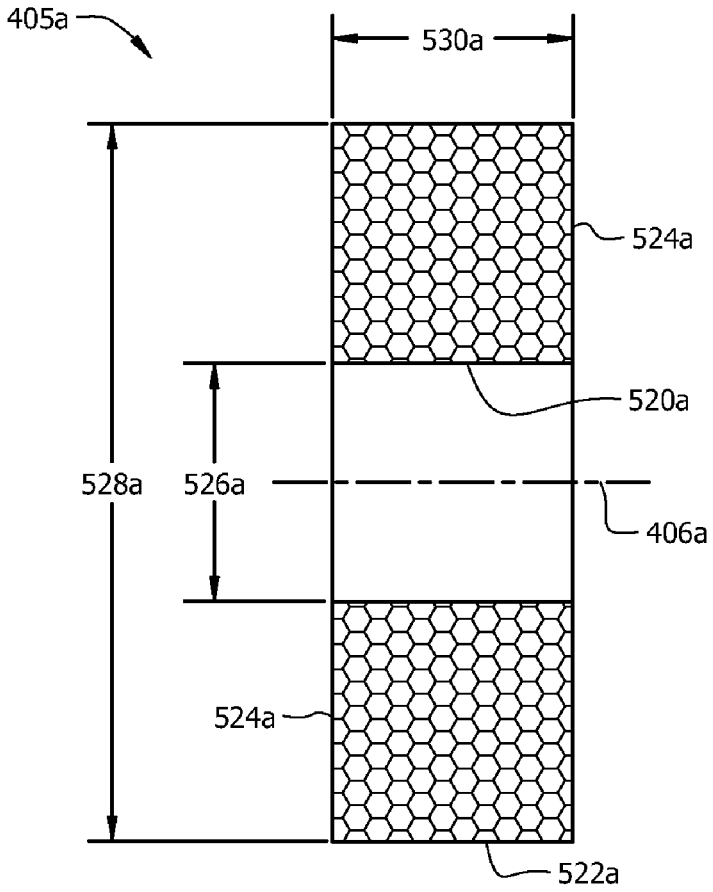
FIG. 33 is a cross-sectional view of a dart centralizer of the dart of FIG. 27.
Figure 34:
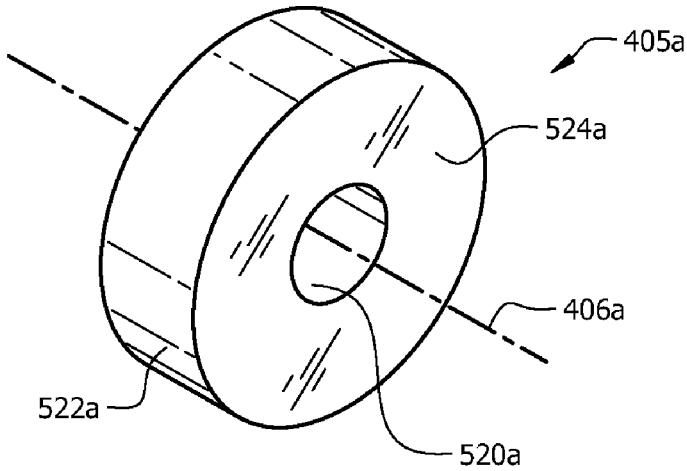
FIG. 34 is an oblique view of the dart centralizer of FIG. 33.

Dart centralizer 405*a* is shown in FIGS. 33 and 34. In this embodiment, dart centralizer 405*a* identical to dart centralizer 405*b*.

It will be appreciated that each of the above sleeve systems 200, 200*b*, and 200*a* are individually operated in substantially the same manner. Accordingly, the below is a description of operation of sleeve system 200 and substantially represents the individual operation of sleeve systems 200*a*-200*e* as well. Sleeve system 200 is initially disposed in the wellbore 114 in the above-described closed position where baffle 250 is retained relative to the ported case 208 by shear screws 248. As such, fluid communication between the sleeve flow bore 216 and a space immediately exterior to the ported case 208 via ports 244 is prevented. When such fluid communication is desired, the dart 400 of sleeve system 200 is sent downhole from a position located uphole of the ported case 208. The dart 400 eventually approaches the ported case 208. It will be appreciated that the longitudinal nature of the dart 400 shape aids in preventing flipping of the dart 400 within the work string 112, thereby ensuring that whichever dart nose 404 was placed in a downhole position relative to the other dart nose 404 of dart 400 predictably remains in the initial downhole position.

Further, it will be appreciated that the dart centralizers 405, while not necessarily contacting and inside diameter of the work string 112, maintains a degree of alignment between the dart central axis 406 and a central axis associated with the components of the work string 112 through which the dart 400 travels. The dart centralizer 405 also serves to reduce dart damage by reducing contact between the other components of the dart 404 with the interior of the work string 112. If the dart 400 is not substantially aligned with the seat central axis 312, the rounded surface 500 of the dart nose 404 may contact seat upper landing surface 308. Such contact in addition to downhole force applied to the dart 400 results in further alignment between the dart central axis 406 and the seat central axis 312 as the rounded surface 500 slides along the seat upper landing surface 308 in a downhole direction. Further, during such movement, the downhole dart centralizer 405 may wipe against the seat upper landing surface 308, thereby cleaning the seat upper landing surface 308 and preparing it for sealing engagement with dart landing seat 428. Next, with sufficient further downhole movement of the dart 400, dart nose tip 478 and centralizer 405 pass through at least a portion of seat passage 310.

Further, with sufficient downhole movement of dart 400, dart nose shelf 474 may contact seat upper landing surface 308 and subsequently enter seat passage 310, both of which actions guarantee further alignment between dart central axis 406 and seat central axis 312. With further sufficient movement downhole of dart 400, dart nose transition 472 may contact seat upper landing surface 308 and subsequently enter seat passage 310, both of which actions guarantee further alignment between dart central axis 406 and seat central axis 312. With still further sufficient movement downhole of dart 400, dart nose base 470 may contact seat upper landing surface 308 and subsequently enter seat passage 310, both of which actions guarantee further alignment between dart central axis 406 and seat central axis 312. With still further sufficient movement downhole of dart 400, central shelf 420 of dart body 402 may contact seat upper landing surface 308 and subsequently enter seat passage 310, both of which actions guarantee further alignment between dart central axis 406 and seat central axis 312. Finally, with still further sufficient movement downhole of dart 400, dart landing seat 428 may contact seat upper landing surface 308, thereby establishing a substantially fluid tight seal between the dart landing seat 428 and seat upper landing surface 308. The act of forming such a seal may itself further align dart central axis 406 and seat central axis 312. It will be appreciated that any of the above-described dart features associated with aligning dart central axis 406 and seat central axis 312 may be referred to as "alignment features."

Once such a seal is established, pressure may be applied to the portion of the work string 112 uphole of the seal until such pressure causes the dart 400 to adequately contribute to the transferring downhole force of a magnitude sufficient to shear the shear screws 248. Once the shear screws 248 have been sheared, downhole movement of the baffle 252 to which the seat 300 is attached is substantially unrestricted. Accordingly, the baffle 250, along with the attached seat 300 and abutted dart 400 slide downhole relative to the ported case 208. As described above, with sufficient downhole movement of the ported case 208, fluid communication between the sleeve flow bore 216 and a space immediately exterior to the ported case 208 via ports 244 is allowed. With sufficient such downhole movement of the baffle 250, the expansion ring 272 may expand and thereby restrict uphole movement of the baffle 250 due to interference between the expansion ring 272 and the lower shoulder 242 of the ported case 208. In this embodiment, dart 400 may be removed from seat 300 by the application of pressure provision of fluid to the portion of the work string downhole of the seal between the dart landing seat 428 and seat upper landing surface 308. Such application pressure and provision of fluid is sometimes referred to as "backflowing." Such backflowing may cause uphole movement of the dart 400 away from the seat 300 so that the dart 400 may be caught within and/or removed from the work string 112. Still further, one or more components of the dart 400 and/or the seat 300 may be selectively degraded, thereby allowing easier backflowing and/or eliminating the need to backflow. Even further, the dart 400 and/or the seat 300 may be drilled out or otherwise manually degraded, manipulated, and/or removed, thereby allowing fluid flow through the ported case 208 in an uphole direction.

Referring now to FIG. 1, a method of servicing wellbore 114 using wellbore servicing system 100 is described. In some cases, wellbore servicing system 100 may be used to selectively treat selected ones of deviated zone 150, first, second, third, four, and fifth horizontal zones 150*a*-150*e*. More specifically, using the above-described method of operating the sleeve systems, any one of the zones 150, 150*a*-150*e* may be treated using the respective associated sleeve systems. For example, treatment of zones 150, 150*a*, and 150*b* without the need for any backflowing or other dart-seat removal processes. To accomplish such treatment, first, dart 400*a* is sent downhole within the work string 112 until dart 400*a* lands on seat 300*a*, thereby enabling fluid communication via ports of sleeve system 200*a* as described above. Once such fluid communication is established, fluids (e.g., a fracturing fluid comprising proppant) may be flowed through the work string 112 through sleeve system 200*a* and into contact with zone 150*a* in a desired manner, thereby treating zone 150*a* (e.g., fracturing the zone and propping the fractures open). After treating zone 150*a*, dart 400*b* is sent downhole within the work string 112 until dart 400*b* lands on seat 300*b*, thereby enabling fluid communication via ports of sleeve system 200*b* as described above. Once such fluid communication is established, fluids may be flowed through the work string 112 through sleeve system 200*b* and into contact with zone 150*b* in a desired manner, thereby treating zone 150*b*. Next, if zones 150*c*-150*e* are not to be treated using sleeve systems 200*c*-200*e*, zone 150 may be treated by sending dart 400 downhole within the work string 112 until dart 400 lands on seat 300, thereby enabling fluid communication via ports 244 of sleeve system 200 as described above. Once such fluid communication is established, fluids may be flowed through the work string 112 through sleeve system 200 and into contact with zone 150 in a desired manner, thereby treating zone 150. After such treatment of zones 150, 150*a*, and 150*b*, each of the darts 400, 400*a*, and 400*b* may be removed from the corresponding seats 300, 300*a*, and 300*b* using a backflowing process or any other means of removal as described above. Once the seals between the darts 400, 400*a*, and 400*b* and the seats 300, 300*a*, and 300*b* have been overcome, in some embodiments, production fluids may pass uphole from zones 150, 150*a*, and 150*b* through the respective associated sleeve systems 200, 200*a*, and 200*b*. It will be appreciated that, in some cases, darts 400, 400*a*, and 400*b* may not be fully removed from the work string 112, but rather, remain captured below adjacent uphole sleeve systems. It will further be appreciated that using the teachings disclosed herein, other selected zones and/or all of the zones 150, 150*a*-150*e* may be treated before a need to remove a dart arises. More specifically, each zone 150, 150*a*-150*e* may be treated using above-described method by operating sleeve systems 200*a*, 200*b*, 200*c*, 200*d*, 200*e*, and 200, beginning with the downhole-most located zone, 150*a*, and subsequently treating zones 200*b*, 200*c*, 200*d*, and 200*e* in this listed order.

Figure 35:
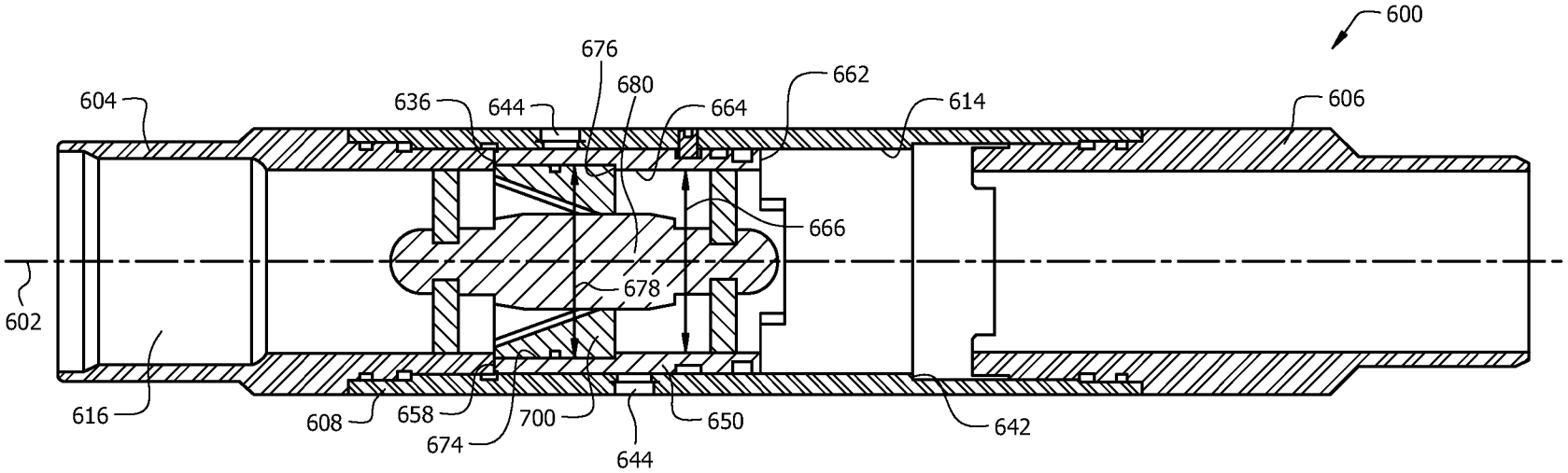
FIG. 35 is a cross-sectional view of an alternative embodiment of a sleeve system in a closed or installation configuration.
Figure 36:
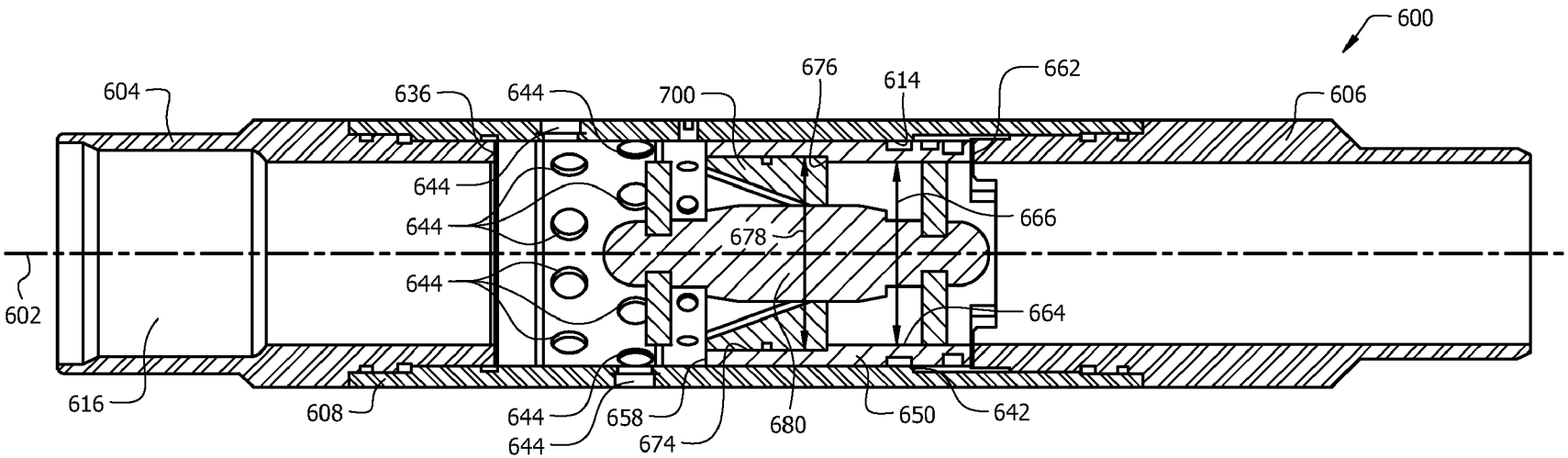
FIG. 36 is a cross-sectional view of the sleeve system of FIG. 35 in an open configuration.
Figure 37:
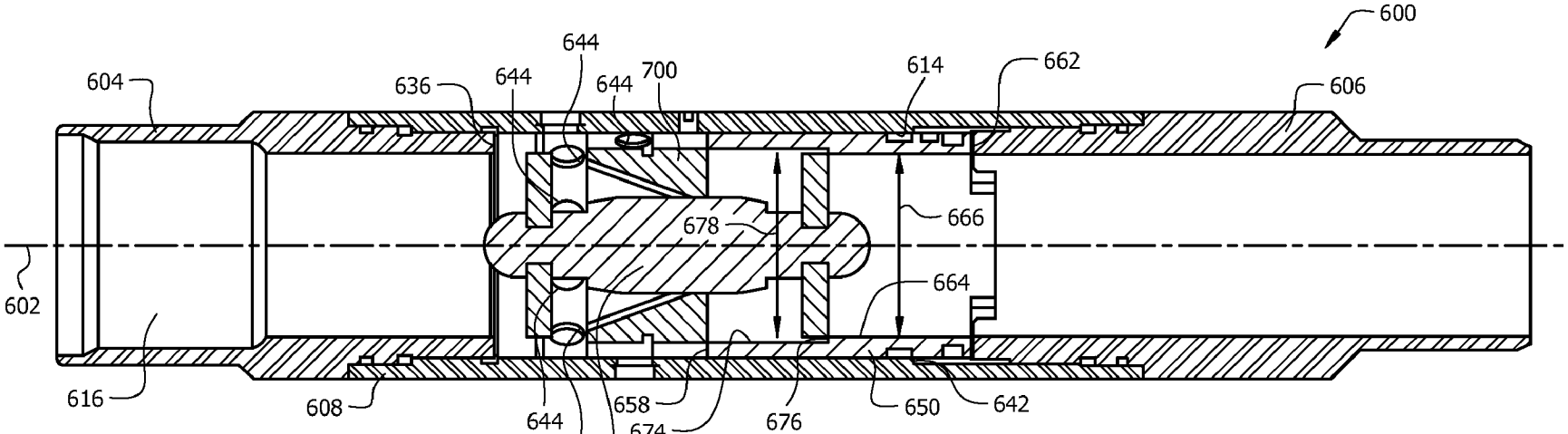
FIG. 37 is a cross-sectional view of the sleeve system of FIG. 35 in a configuration with a seat at least partially removed from a baffle.

Referring now to FIGS. 35-37, another embodiment of a sleeve system 600 is shown. Sleeve system 600 is substantially similar to sleeve system 200. Sleeve system 600 comprises a central axis 602, an upper adapter 604, a lower adapter 606, and a ported case 608. The ported case 608 comprises an inner surface 614 and the sleeve system 600 comprises a sleeve flow bore 616. Upper adapter 604 comprises an upper shoulder 636 substantially similar to upper shoulder 236 and ported case 608 comprises a lower shoulder 642 substantially similar to lower shoulder 242. Further, sleeve system 600 comprises a baffle 650 substantially similar to baffle 250. Baffle 650 comprises an upper end 658 and a lower end 662. However, while an exterior surface 654 of the baffle 650 is substantially similar to exterior surface 254, an inner surface 664 of baffle 650 is different from inner surface 264 of baffle 250. More specifically, inner surface 664 of baffle 650 is not threaded near a lower end 662 of baffle 650 to receive a seat 700. Instead, seat 700 is received within a baffle groove 674 formed in the inner surface 664. The baffle groove 674 extends from a baffle shoulder 676 to the upper end 658 of baffle 650. The baffle groove 674 comprises a baffle groove diameter 678 is larger than the inner surface diameter 666 of baffle 650. Accordingly, when sleeve system 600 is configured in an installation configuration and/or closed position where baffle 650 prevents fluid communication as described above (see FIG. 35) with regard to baffle 250, seat 700 is captured within baffle groove 674 between baffle shoulder 676 and the upper shoulder 636 of the upper adapter 604.

Further, seat 700 is frangible as described in greater detail below. The frangible nature of seat 700 causes the overall operation of sleeve system 600 to differ from operation of sleeve system 200. Specifically, as a dart 680 contacts seat 700 and substantially similar manner as dart 400 contacts seat 300, dart 680, baffle 650, and the seat 700 captured between dart 680 and the baffle 650 may be moved in a downhole direction to allow the above-described fluid communication through ports 644. FIG. 36 shows dart 680, baffle 650, and the seat 700 after being moved to a fully open position where uphole movement of baffle 650 is restricted by expansion ring 672 potentially interfering with lower shoulder 642 of ported case 608. After passing fluids through ports 644 to treat an associated wellbore zone, fluid pressure may be applied to downhole side of the dart 680 and seat 700, for example, during a backflowing process. Such pressure and fluid flow may then cause uphole movement of the dart 660 and/or the seat 700 relative to the baffle 650 as shown in FIG. 37. Such uphole movement allows the seat 700 to exit the baffle 650. As shown in FIG. 37, the seat 700 is no longer restrained within baffle groove 674, but rather, is free to move uphole within sleeve flow bore 616. During such a backflowing process, the seat 700 may break into multiple pieces. Accordingly, the dart 680 and pieces of the seat 700 may flow in an uphole direction through upper adapter 604 and other portions of the associated work string.

Figure 38:
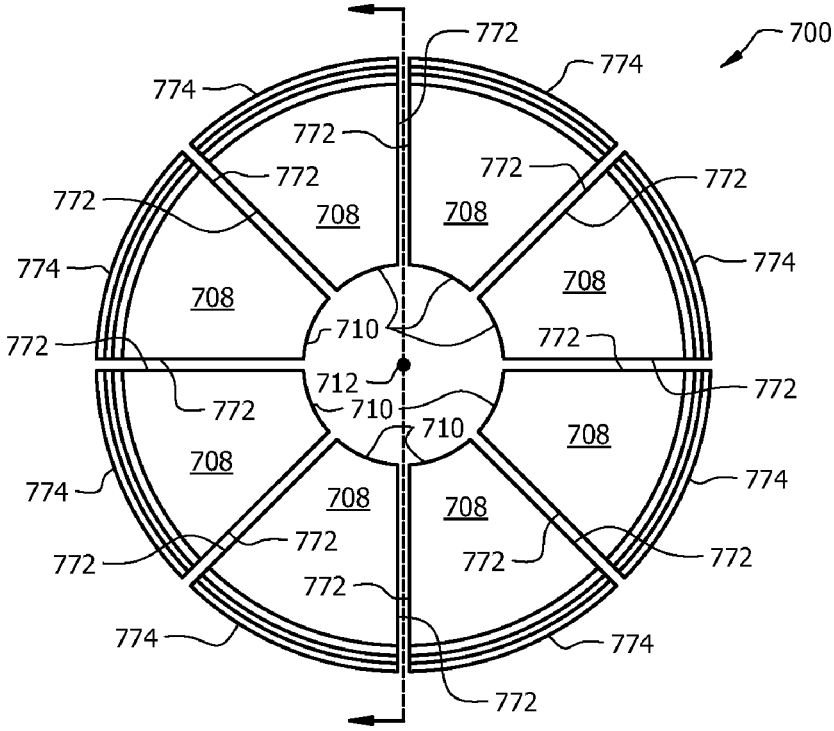
FIG. 38 is an orthogonal end view of a seat of the sleeve system of FIG. 35.
Figure 39:
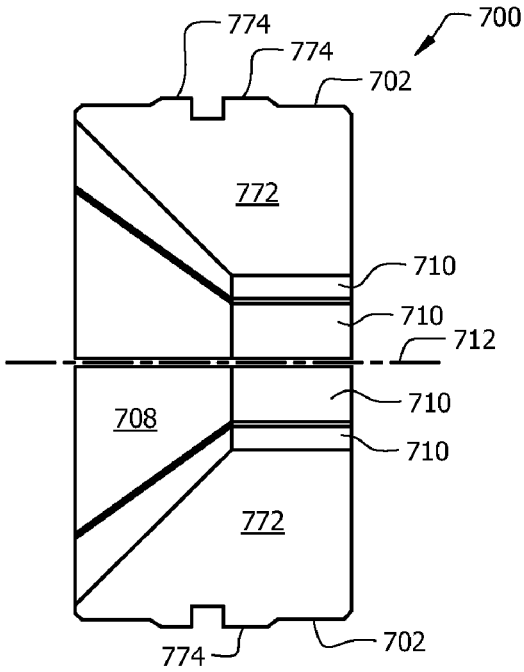
FIG. 39 is a cross-sectional view of the seat of FIG. 38.
Figure 40:
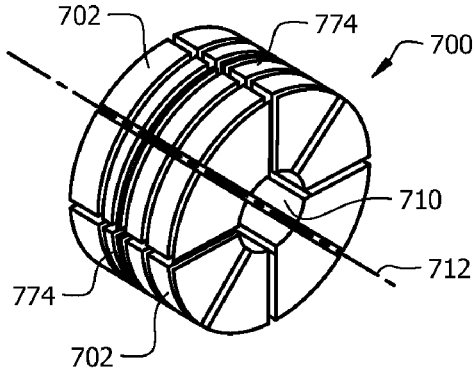
FIG. 40 is an oblique view of the seat of FIG. 38.

Referring now to FIGS. 38-40, the frangible seat 700 is shown in greater detail. Seat 700 is substantially formed as an annular ring having a substantially cylindrical passage 710 and a substantially frusto-conical seat upper landing surface 708. Seat upper landing surface 708 and passage 710 perform in substantially the same manner as seat upper landing surface 308 and passage 310, respectively. However, seat upper landing surface 708 and passage 710 are not substantially formed by a single piece of material, but rather, the seat 700 and the features of seat 700 are formed of a plurality of seat pieces 770. Seat pieces 770 are each substantially similar in shape and size and are each radially disposed about seat axis 712 in a substantially equidistant manner. Seat pieces 770 each have sidewalls 772 that are configured to receive adhesive, epoxy, or any other suitable material or device for positionally retaining the plurality of seat pieces 770 relative to each other in the manner shown in FIGS. 38-40. Seat 700 further comprises raised shoulders 774 along the exterior surface 702. An o-ring, band, seal, retaining ring, or any other suitable material or device may be received between raised shoulders 774 to selectively retaining seat pieces 770 relative to each other and/or to provide a seal between seat 700 and baffle groove 674 of baffle 650.

Figure 41:
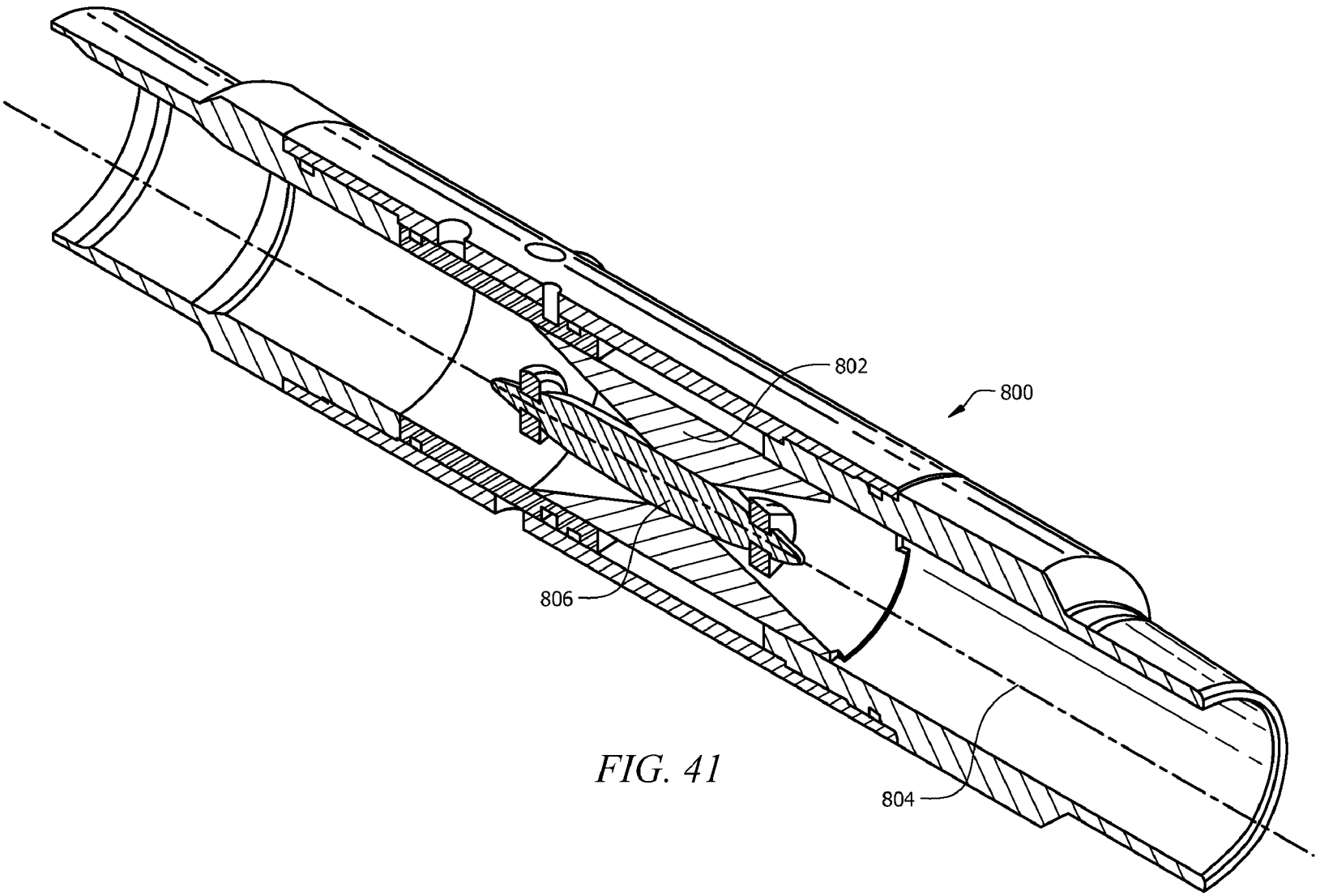
FIG. 41 is an oblique cut-away view of yet another alternative embodiment of a sleeve system.

Referring now to FIG. 41, an alternative embodiment of a sleeve system 800 is shown. Sleeve system 800 is substantially similar to sleeve system 200, however, a seat 802 is substantially symmetrical along a seat axis 804. In some embodiments, provision such a symmetrical seat 802 may better enable passage of darts through seat 802 in an uphole direction and/or may better enable dislodging a dart 806 from the seat 802.

Figure 42:
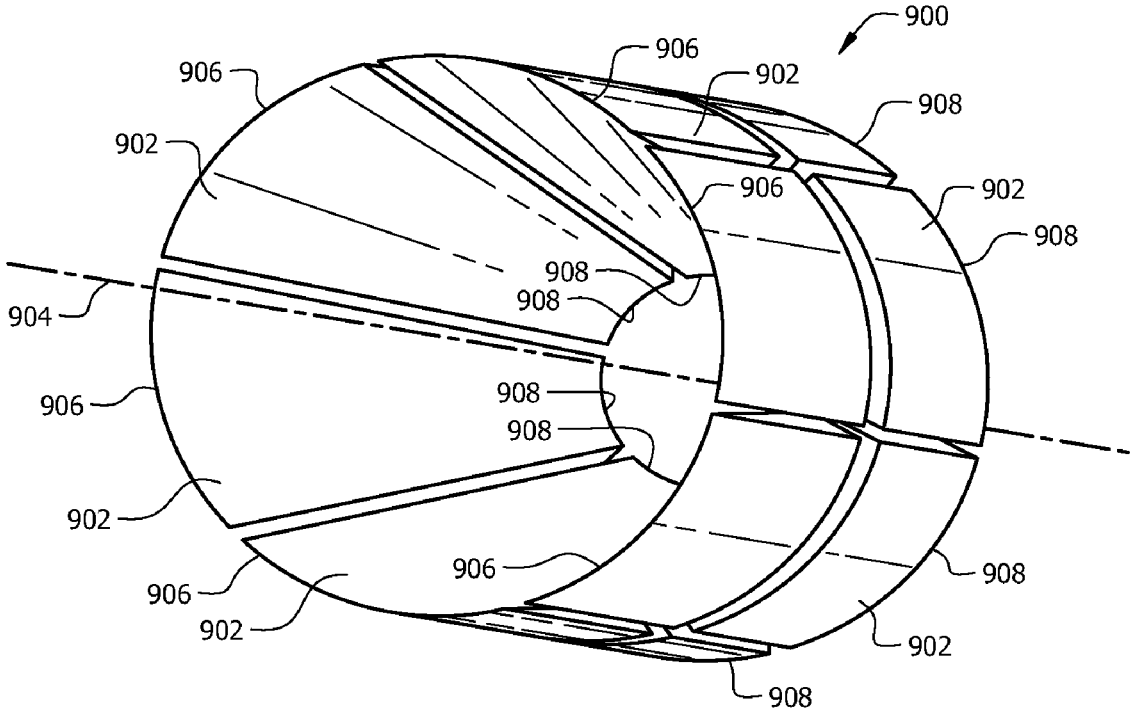
FIG. 42 is an oblique view of another alternative embodiment of a seat.

Referring now to FIG. 42, an alternative embodiment of a frangible seat 900 is shown. The frangible seat 900 is substantially similar to frangible seat 700, however, seat 900 is formed so that seat pieces 902 have increasing angular dimension about a seat central axis 904 so that uphole ends 906 of seat pieces 902 have greater angular dimensions than downhole ends 908 of the seat pieces 902. In some embodiments, provision such a seat pieces 902 may provide improved sealing between darts and the seat 900 and/or may better enable dislodging a dart from the seat 900.

Figure 43:
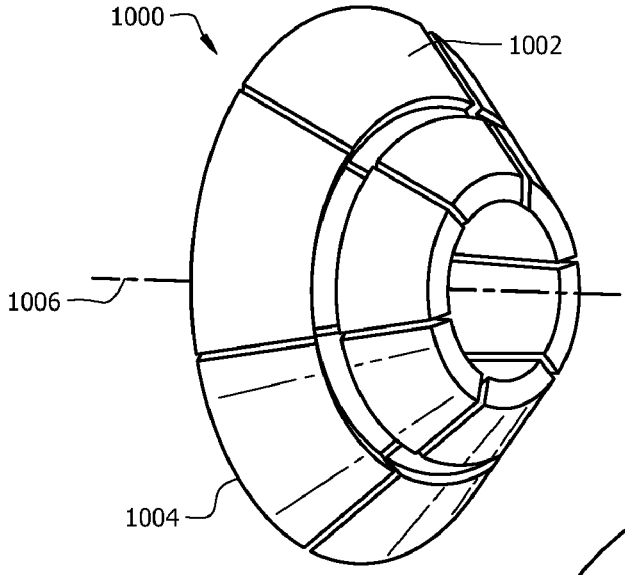
FIG. 43 is an oblique bottom view of another alternative embodiment of a seat.
Figure 44:
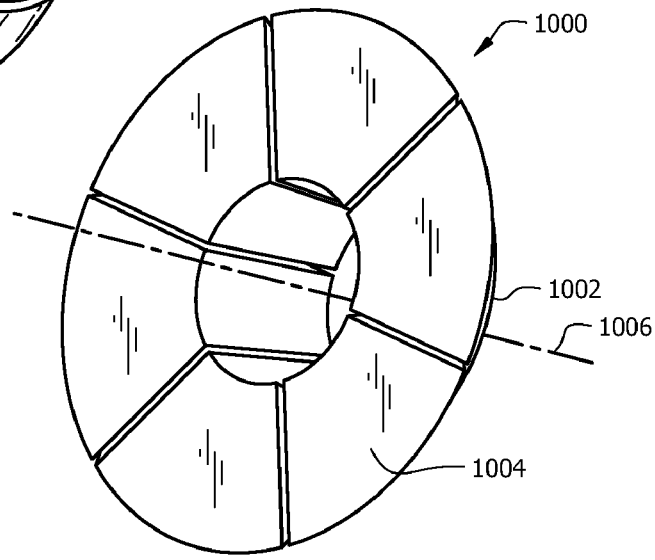
FIG. 44 is an oblique top view of the seat of FIG. 43.
Figure 45:
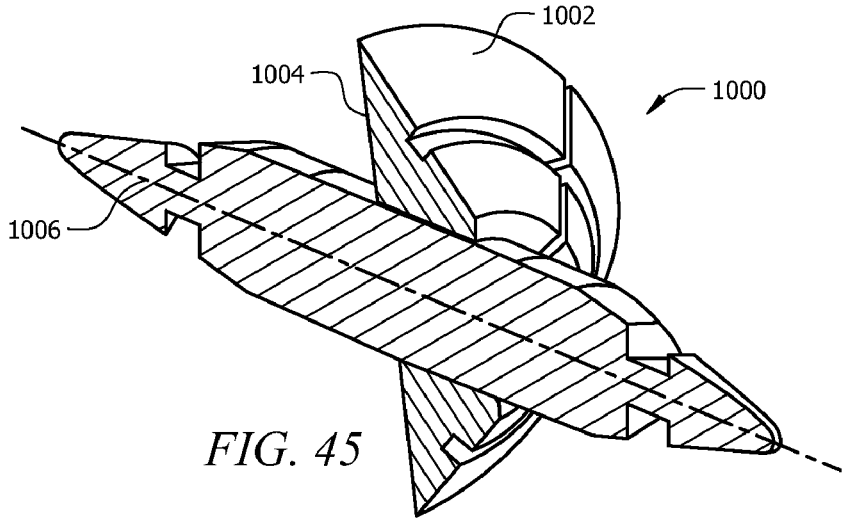
FIG. 45 is a cut-away view of the seat of FIG. 43 and another alternative embodiment of a dart.

Referring now to FIGS. 43-45, an alternative embodiment of a frangible seat 1000 is shown. The frangible seat 1000 is substantially similar to frangible seat 700, however, frangible seat 1000 comprises have generally frusto-conical shaped downhole profile 1002. Further, frangible seat 1000 comprises a substantially enlarged uphole profile 1004 that is substantially orthogonal to seat axis 1006.

Figure 46:
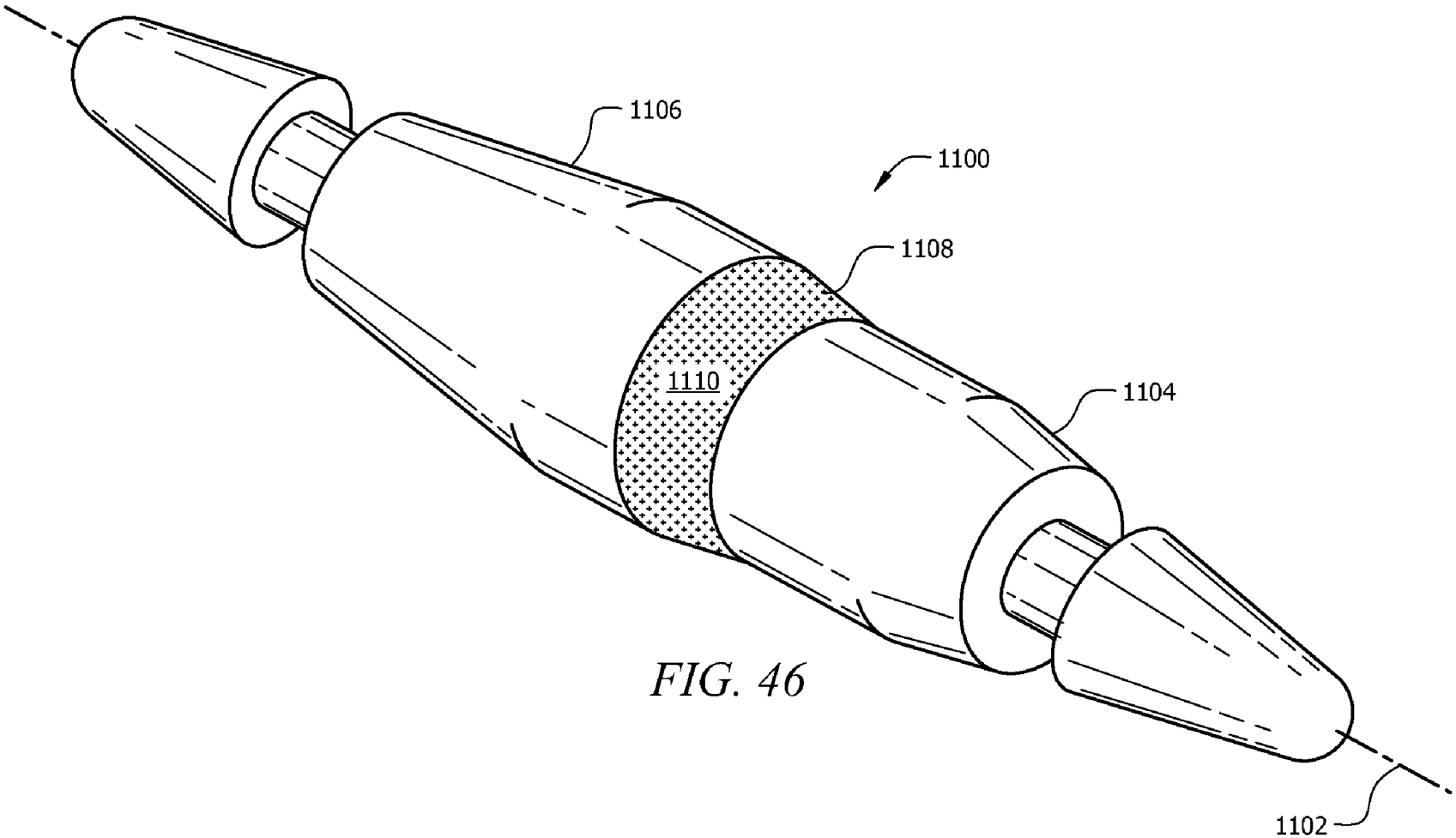
FIG. 46 is an oblique view of another alternative embodiment of a dart.
Figure 47:
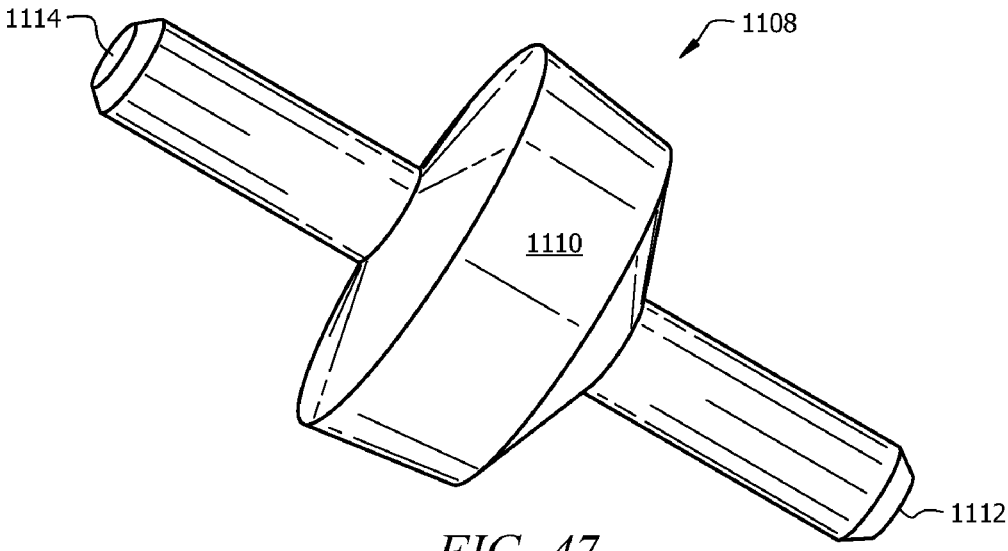
FIG. 47 is an oblique view of a dart body of the dart of FIG. 46.

Referring now to FIGS. 46-47, an alternative embodiment of a dart 1100 is shown. Dart 1100 is not symmetrical about dart axis 1102. Instead, dart 1100 comprises a downhole dart nose 1104, an uphole dart nose 1106, and a dart body 1108 having a single dart landing surface 1110. Dart body 1108 is shown in FIG. 47 as comprising a dart body downhole end 1112 and a dart body uphole end 1114.

Figure 48:
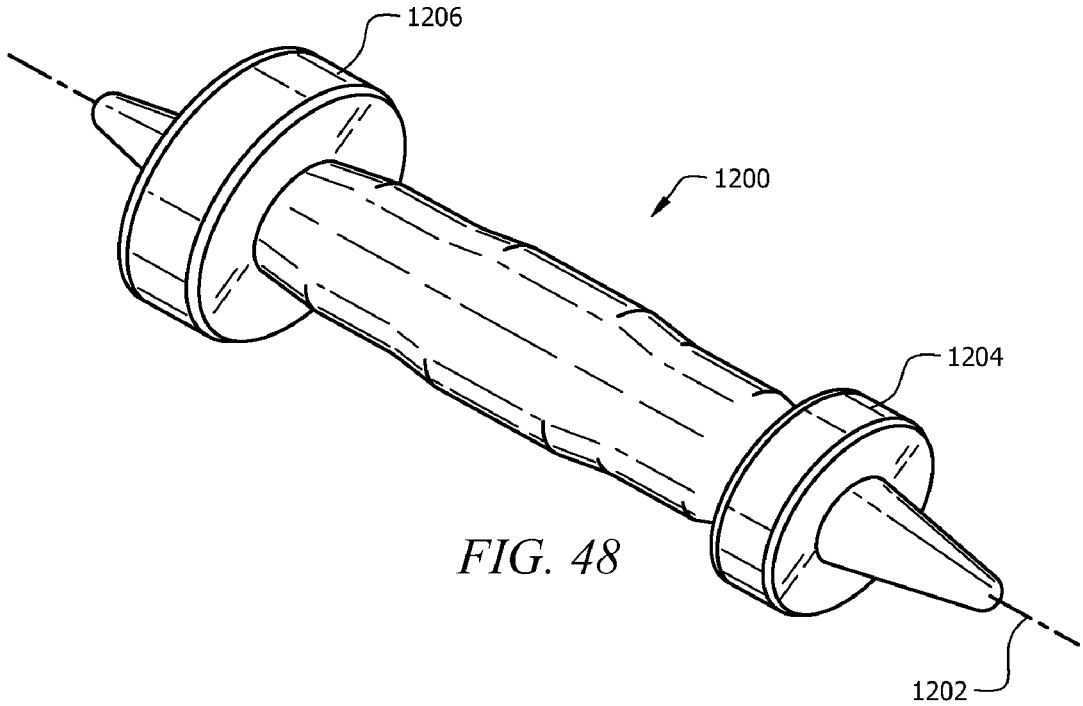
FIG. 48 is an oblique view of still another alternative embodiment of a dart.
Figure 49:
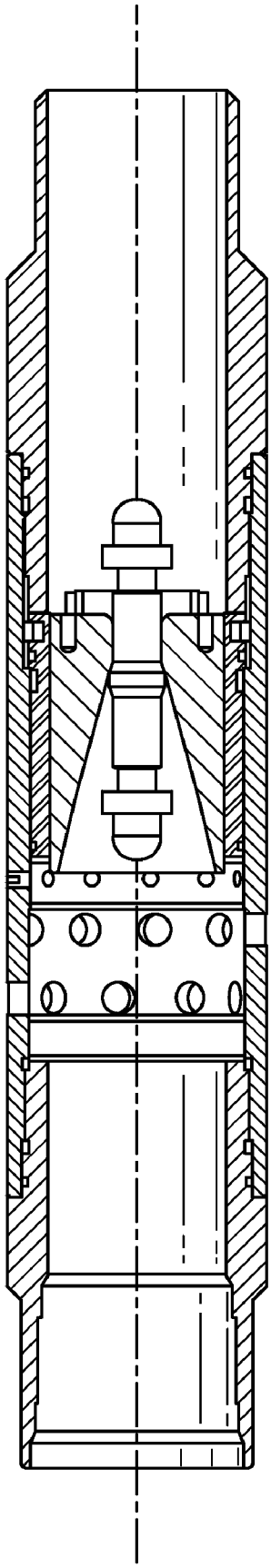
FIG. 49 is a cut-away view of another alternative embodiment of a sleeve system.
Figure 50:
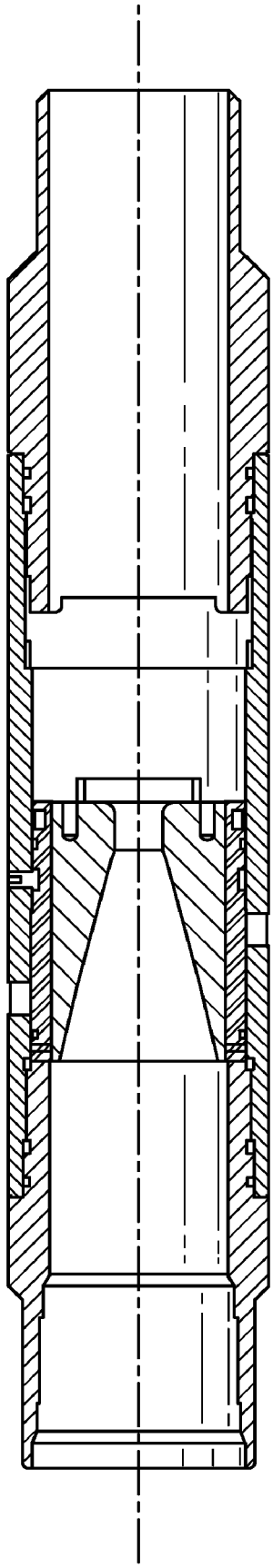
FIG. 50 is a cut-away view of a seat and other components of the sleeve system of FIG. 49.
Figure 51:
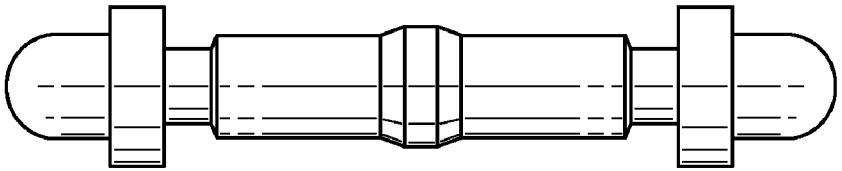
FIG. 51 is an orthogonal side view of a dart of the sleeve system of FIG. 49.
Figure 52:
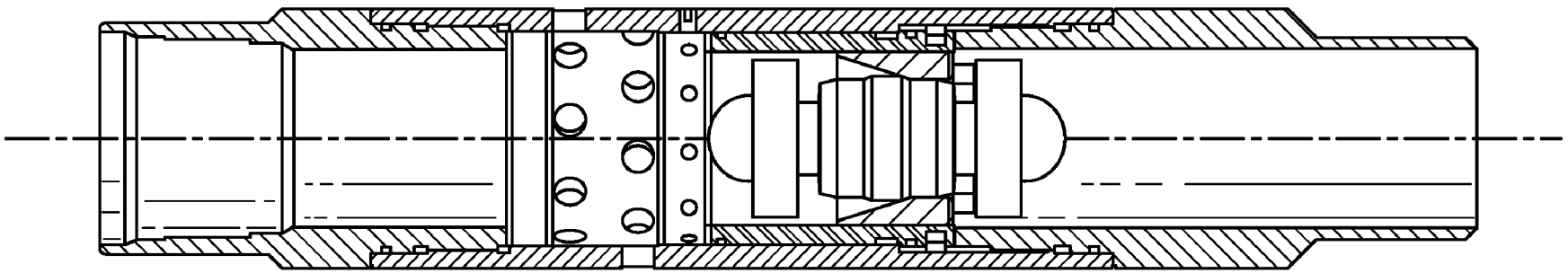
FIG. 52 is a cut-away view of yet another alternative embodiment of a sleeve system.
Figure 53:
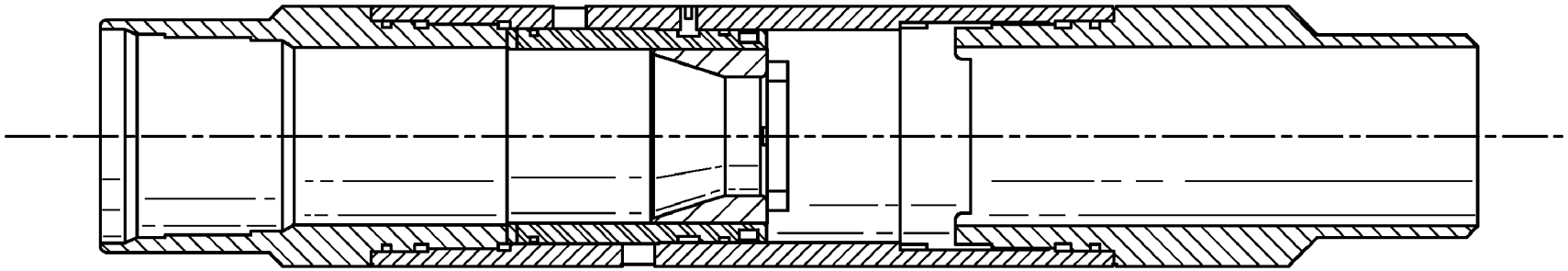
FIG. 53 is a cut-away view of a seat and other components of the sleeve system of FIG. 52.
Figure 54:
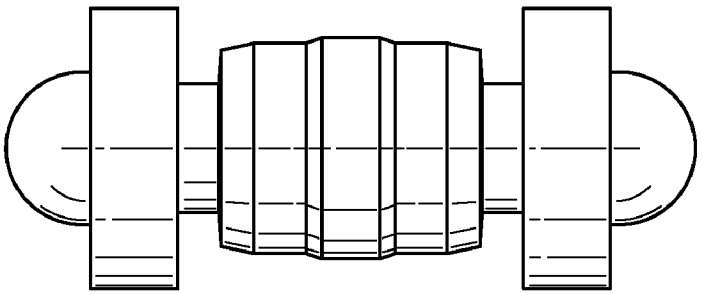
FIG. 54 is an orthogonal side view of a dart of the sleeve system of FIG. 52.
Figure 55:
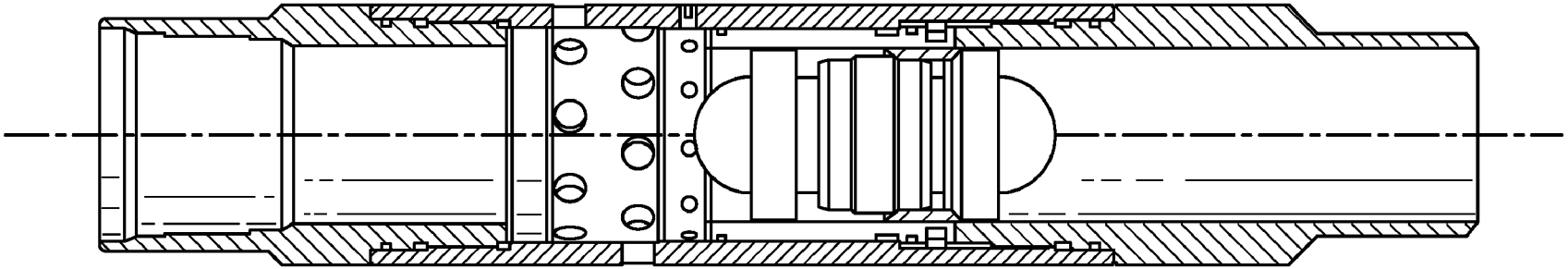
FIG. 55 is a cut-away view of still another alternative embodiment of a sleeve system.
Figure 56:
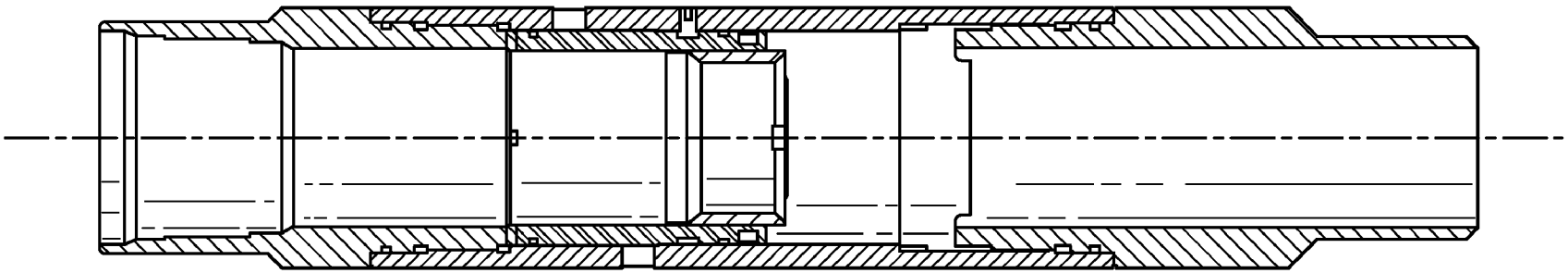
FIG. 56 is a cut-away view of a seat and other components of the sleeve system of FIG. 55.
Figure 57:
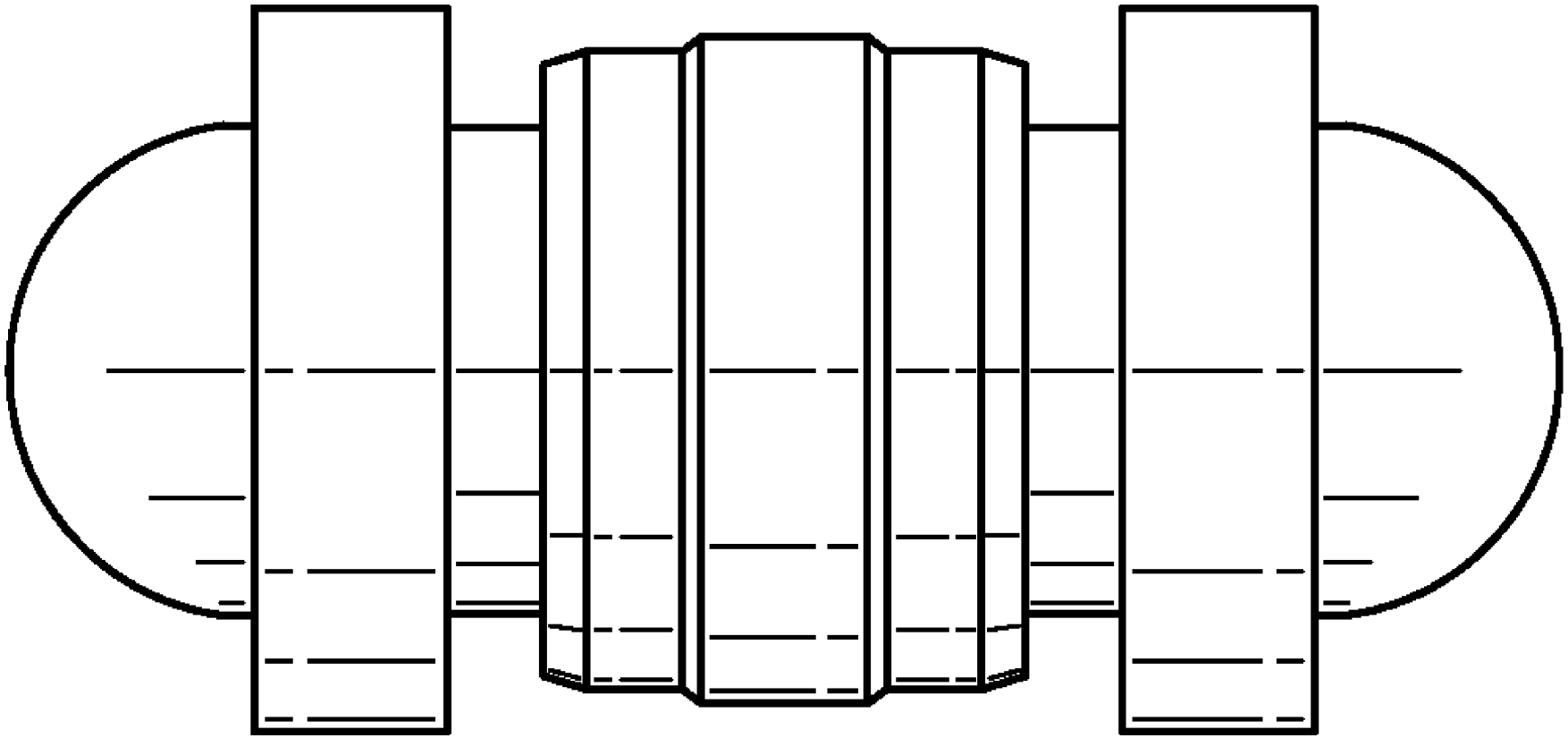
FIG. 57 is an orthogonal side view of a dart of the sleeve system of FIG. 55.

Referring now to FIG. 48, an alternative embodiment of a dart 1200 is shown. Dart 1200 is not symmetrical about dart axis 1202. Instead, dart 1200 comprises a substantially annular ring shaped first dart centralizer 1204 that is smaller in outside diameter than a substantially annular ring shaped second dart centralizer 1206.

In some embodiments, one or more components of the sleeve systems disclosed herein comprise a degradable material. Herein, the term "degradable materials" refer to materials that readily and irreversibly undergo a significant change in chemical structure under specific environmental conditions that result in the loss of some properties. For example, the degradable material may undergo hydrolytic degradation that ranges from the relatively extreme cases of heterogeneous (or bulk erosion) to homogeneous (or surface erosion), and any stage of degradation in between. In some embodiments, the components are degraded under defined conditions (e.g., as a function time, exposure to chemical agents, etc.) to such an extent that the components are structurally compromised and will no longer function for their intended purpose. In an alternative embodiment, the components can be degraded under defined conditions to such an extent that the component no longer maintains its original form and is transformed from a component having defined structural features consistent with its intended function to a plurality of masses lacking features consistent with its intended function.

In some embodiments, the degradable material is any material capable of being degraded as described previously herein and that may be formed into the components. The degradable material may be further characterized by possessing physical and/or mechanical properties that are compatible with its use in a wellbore servicing operation. In choosing the appropriate degradable material, one should consider the degradation products that will result. Also, these degradation products should not adversely affect other operations or components. One of ordinary skill in the art, with the benefit of this disclosure, will be able to recognize which degradable materials would produce degradation products that would adversely affect other operations or components.

In some embodiments, the components are comprised of a degradable polymer. The degradability of a polymer depends at least in part on its backbone structure. For instance, the presence of hydrolyzable and/or oxidizable linkages in the backbone often yields a material that will degrade as described herein. The rates at which such polymers degrade are dependent on the type of repetitive unit, composition, sequence, length, molecular geometry, molecular weight, morphology (e.g., crystallinity, size of spherulites, and orientation), hydrophilicity, hydrophobicity, surface area, and additives. The degradable polymer may be chemically modified (e.g., chemical functionalization) in order to adjust the rate at which these materials degrade. Such adjustments may be made by one of ordinary skill in the art with the benefits of this disclosure. Further, the environment to which the polymer is subjected may affect how it degrades, e.g., temperature, presence of moisture, oxygen, microorganisms, enzymes, pH, and the like.

Examples of degradable polymers suitable for use in this disclosure include, but are not limited to, homopolymers, random, block, graft, and star- and hyper-branched aliphatic polyesters. Specific examples of suitable polymers include, but are not limited to, polysaccharides such as dextran or cellulose; chitin; chitosan; proteins; orthoesters; aliphatic polyesters; poly(lactide); poly(glycolide); poly(.epsilon.-caprolactone); poly(hydroxybutyrate); poly(anhydrides); aliphatic polycarbonates; poly(orthoesters); poly(amino acids); poly(ethylene oxide); and polyphosphazenes. Such degradable polymers may be prepared by polycondensation reactions, ring-opening polymerizations, free radical polymerizations, anionic polymerizations, carbocationic polymerizations, and coordinative ring-opening polymerization for, e.g., lactones, and any other suitable process.

In some embodiments, one or more components are comprised of a biodegradable material. Herein biodegradable materials refer to materials comprised of organic components that degrade over a relatively short period of time. Typically such materials are obtained from renewable raw materials. In some embodiments, the components are comprised of a biodegradable polymer comprising aliphatic polyesters, polyanhydrides or combinations thereof.

In some embodiments, the components are comprised of a biodegradable polymer comprising an aliphatic polyester. Aliphatic polyesters degrade chemically, inter alia, by hydrolytic cleavage. Hydrolysis can be catalyzed by either acids or bases. Generally, during the hydrolysis, carboxylic end groups are formed during chain scission, and this may enhance the rate of further hydrolysis. This mechanism is known in the art as "autocatalysis," and is thought to make polyester matrices more bulk eroding.

Suitable aliphatic polyesters have the general formula of repeating units shown below:

Formula I

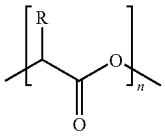

where n is an integer between 75 and 10,000 and R is selected from the group consisting of hydrogen, alkyl, aryl, alkylaryl, acetyl, heteroatoms, and mixtures thereof. In some embodiments, the aliphatic polyester is poly(lactide). Poly(lactide) is synthesized either from lactic acid by a condensation reaction or more commonly by ring-opening polymerization of cyclic lactide monomer. Since both lactic acid and lactide can achieve the same repeating unit, the general term poly(lactic acid) as used herein refers to Formula I without any limitation as to how the polymer was made such as from lactides, lactic acid, or oligomers, and without reference to the degree of polymerization or level of plasticization.

The lactide monomer exists generally in three different forms: two stereoisomers L- and D-lactide and racemic D,L-lactide (meso-lactide). The oligomers of lactic acid, and oligomers of lactide are defined by the formula:

Formula II

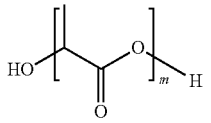

where m is an integer: 2≦m≦75. Alternatively m is an integer: 2≦m≦10. These limits correspond to number average molecular weights below about 5,400 and below about 720, respectively.

In some embodiments, the aliphatic polyester is poly(lactic acid). D-lactide is a dilactone, or cyclic dimer, of D-lactic acid. Similarly, L-lactide is a cyclic dimer of L-lactic acid. Meso D,L-lactide is a cyclic dimer of D-, and L-lactic acid. Racemic D,L-lactide comprises a 50/50 mixture of D-, and L-lactide. When used alone herein, the term "D,L-lactide" is intended to include meso D,L-lactide or racemic D,L-lactide. Poly(lactic acid) may be prepared from one or more of the above. The chirality of the lactide units provides a means to adjust degradation rates as well as physical and mechanical properties. Poly(L-lactide), for instance, is a semicrystalline polymer with a relatively slow hydrolysis rate. This may be advantageous for downhole operations where slow degradation may be appropriate. Poly(D,L-lactide) is an amorphous polymer with a faster hydrolysis rate. This may be advantageous for downhole operations where a more rapid degradation may be appropriate.

The stereoisomers of lactic acid may be used individually or combined in accordance with the present disclosure. Additionally, they may be copolymerized with, for example, glycolide or other monomers like ϵ-caprolactone, 1,5-dioxepan-2-one, trimethylene carbonate, or other suitable monomers to obtain polymers with different properties or degradation times. Additionally, the lactic acid stereoisomers can be modified by blending, copolymerizing or otherwise mixing high and low molecular weight polylactides; or by blending, copolymerizing or otherwise mixing a polylactide with another polyester or polyesters.

The aliphatic polyesters may be prepared by substantially any of the conventionally known manufacturing methods such as those described in U.S. Pat. Nos. 6,323,307; 5,216,050; 4,387,769; 3,912,692; and 2,703,316, the relevant disclosure of which are incorporated herein by reference.

In some embodiments, the biodegradable polymer comprises a plasticizer. Suitable plasticizers include but are not limited to derivatives of oligomeric lactic acid, selected from the group defined by the formula:

Formula III

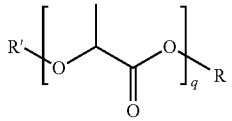

where R is a hydrogen, alkyl, aryl, alkylaryl, acetyl, heteroatom, or a mixture thereof and R is saturated, where R' is a hydrogen, alkyl, aryl, alkylaryl, acetyl, heteroatom, or a mixture thereof and R' is saturated, where R and R' cannot both be hydrogen, where q is an integer: 2≦q≦75; and mixtures thereof. Alternatively q is an integer: 2≦q≦10. As used herein the term "derivatives of oligomeric lactic acid" includes derivatives of oligomeric lactide.

The plasticizers may be present in any amount that provides the desired characteristics. For example, the various types of plasticizers discussed herein provide for (a) more effective compatibilization of the melt blend components; (b) improved processing characteristics during the blending and processing steps; and (c) control and regulate the sensitivity and degradation of the polymer by moisture. For pliability, plasticizer is present in higher amounts while other characteristics are enhanced by lower amounts. The compositions allow many of the desirable characteristics of pure nondegradable polymers. In addition, the presence of plasticizer facilitates melt processing, and enhances the degradation rate of the compositions in contact with the wellbore environment. The intimately plasticized composition may be processed into a final product in a manner adapted to retain the plasticizer as an intimate dispersion in the polymer for certain properties. These can include: (1) quenching the composition at a rate adapted to retain the plasticizer as an intimate dispersion; (2) melt processing and quenching the composition at a rate adapted to retain the plasticizer as an intimate dispersion; and (3) processing the composition into a final product in a manner adapted to maintain the plasticizer as an intimate dispersion. In certain embodiments, the plasticizers are at least intimately dispersed within the aliphatic polyester.

In some embodiments, the biodegradable material is a poly(anhydride). Poly(anhydride) hydrolysis proceeds, inter alia, via free carboxylic acid chain-ends to yield carboxylic acids as final degradation products. The erosion time can be varied by variation of the polymer backbone. Examples of suitable poly(anhydrides) include without limitation poly(adipic anhydride), poly(suberic anhydride), poly(sebacic anhydride), and poly(dodecanedioic anhydride). Other suitable examples include but are not limited to poly(maleic anhydride) and poly(benzoic anhydride).

In various embodiments, the components are self-degradable. Namely, the components, are formed from biodegradable materials comprising a mixture of a degradable polymer, such as the aliphatic polyesters or poly(anhydrides) previously described, and a hydrated organic or inorganic solid compound. The degradable polymer will at least partially degrade in the releasable water provided by the hydrated organic or inorganic compound, which dehydrates over time when heated due to exposure to the wellbore environment.

Examples of the hydrated organic or inorganic solid compounds that can be utilized in the self-degradable components include, but are not limited to, hydrates of organic acids or their salts such as sodium acetate trihydrate, L-tartaric acid disodium salt dihydrate, sodium citrate dihydrate, hydrates of inorganic acids or their salts such as sodium tetraborate decahydrate, sodium hydrogen phosphate heptahydrate, sodium phosphate dodecahydrate, amylose, starch-based hydrophilic polymers, and cellulose-based hydrophilic polymers.

In some embodiments, the components comprised of degradable materials of the type described herein are degraded subsequent to the performance of their intended function. Degradable materials and method of utilizing same are described in more detail in U.S. Pat. No. 7,093,664 which is incorporated by reference herein in its entirety.

In some embodiments, the darts and/or seats of the present disclosure may comprise Garolite. More specifically, some embodiments of the darts and/or seats of the present disclosure may comprise High-Temperature Garolite (G-11 Epoxy Grade).

In some embodiments, the darts and/or seats of the present disclosure may comprise resins or epoxies that are at least partially degradable by exposure to water.

In some embodiments, components may be held, adhered, and/or otherwise maintained in a relative spatial relationship using an epoxy, resin, and/or epoxy resin. More specifically, components of some embodiments may be held, adhered, and/or otherwise maintained in a relative spatial relationship using Weld-Aid epoxy resin.

It will be appreciated that a wellbore servicing system comprising a plurality of sleeve systems disposed along a wellbore may be configured so that a seat passage inside diameter of an intermediate sleeve system is smaller than all of the seat passage inside diameters of the sleeve systems located uphole of the intermediate sleeve system.

It will be appreciated that a wellbore servicing system comprising a plurality of sleeve systems disposed along a wellbore may be configured so that a seat upper landing surface angle of an intermediate sleeve system is smaller than all of the seat upper landing surface angles of the sleeve systems located uphole of the intermediate sleeve system.

It will be appreciated that a wellbore servicing system comprising a plurality of sleeve systems disposed along a wellbore may be configured so that dart landing seat angles of each sleeve system is substantially the same angle of each associated seat upper landing surface angle.

It will be appreciated that a wellbore servicing system comprising a plurality of sleeve systems disposed along a wellbore may be configured so that dart landing seat angles of each sleeve system is substantially complementary to each associated seat upper landing surface angle.

It will be appreciated that any seat, dart, and/or components thereof may comprise any of the materials described herein. Further, it will be appreciated that components of the sleeve systems disclosed herein may be formed of degradable and/or selectively degradable materials that improve the ease of and/or eliminate the need for backflowing, drilling, and/or other component removal procedures.

It will be appreciated that a wellbore servicing system comprising a plurality of sleeve systems disposed along a wellbore may be configured so that darts with relatively larger central ring diameters and/or dart outside diameters are constructed of materials having relatively higher compressive strength than darts with relatively smaller central ring diameters and/or dart outside diameters.

It will be appreciated that a wellbore servicing system comprising a plurality of sleeve systems disposed along a wellbore may be configured so that darts with relatively larger central ring diameters and/or dart outside diameters are constructed of materials having relatively higher hardness than darts with relatively smaller central ring diameters and/or dart outside diameters.

It will be appreciated that darts may be constructed of the plurality of materials and so that dart noses are constructed of relatively softer materials as compared to relatively harder materials used to construct dart bodies.

It will be appreciated that darts may be constructed integrally as a single unit and/or of a single material and so that dart landing seats are relatively harder and/or have higher compressive strength than dart noses. In other words, any of the darts disclosed herein described as being constructed of multiple components (such as dart bodies, dart noses, and/or dart centralizers) may alternatively be constructed integrally as a single unit and/or in a manner comprising more or fewer discrete components.

It will be appreciated that a radius of curvature of a rounded surface of a dart nose tip may have a value of at least about 0.5 inches, thereby improving dart compatibility with being launched from existing ball drop system ball launchers.

It will be appreciated that any dart may comprise one or more of the alignment features disclosed herein.

It will be appreciated that a sealing surface area between a dart landing seat and a seat upper landing seat may be increased by reducing the seat upper landing surface angle and reducing the associated dart landing seat angle.

It will be appreciated that a wellbore servicing system comprising a plurality of sleeve systems disposed along a wellbore may be configured so that seats with relatively larger seat passages and/or interior surface diameters may be constructed of materials having relatively higher compressive strength than seats with relatively smaller seat passages and/or interior surface diameters.

It will be appreciated that one or more components of sleeve system may be selectively configured to have a desired specific gravity. More specifically, such components may be selectively configured to comprise a specific gravity of about 1.7. For example, when a dart substantially similar to dart 400 comprises a dart body constructed of cast iron, dart noses constructed of materials less dense than cast iron, and dart centralizers constructed of foam, material may be removed from the interior of the dart body to achieve a lower dart specific gravity.

It will be appreciated that a wellbore servicing system substantially similar to wellbore servicing system 100 may be configured so that portions of substantially all seats and darts comprise cast iron. More specifically, cast iron may be used to construct any of the components that serve to form a seal between a dart and an associated seat.

It will be appreciated that in a wellbore servicing system substantially similar to wellbore servicing system 100, darts comprising dart central shelves substantially similar to dart central shelves 420 may be increasingly advantageous as a seat upper landing surface angle is relatively larger. For example, dart central shelves may be substantially less advantageous and/or unnecessary when a seat upper landing surface angle is about 20° or less.

It will be appreciated that in some embodiments of a dart that is not symmetrical along a dart central axis, an entire portion of the dart on a single side of what would be a bisection plane in dart 400, may be replaced by a substantially cylindrical tail having a tail outside diameter substantially similar in size to a central ring diameter of the dart.

It will be appreciated that in a wellbore servicing system substantially similar to wellbore servicing system 100, a "minimum gap" may be described as the minimum acceptable difference in size between a dart outside diameter and a seat passage diameter through which the dart must fully pass. In some embodiments, the minimum gap may be within a range of about 0.010 inches to about 0.11 inches, alternatively about 0.20 inches to about 0.10 inches, alternatively about 0.030 inches to about 0.090 inches, alternatively about 0.040 inches to about 0.080 inches, alternatively about 0.050 inches to about 0.070 inches, alternatively about 0.055 inches to about 0.065 inches, alternatively about 0.059 inches to about 0.061 inches. In another embodiment, the minimum gap may be about 0.060 inches. Using a minimum gap of about 0.060 inches allow for using more than 8 sleeve systems within a 4.5 inch casing, alternatively more than 10 sleeve systems within a 4.5 inch casing, alternatively more than 12 sleeve systems within a 4.5 inch casing, alternatively more than 14 sleeve systems within a 4.5 inch casing, alternatively more than 16 sleeve systems within a 4.5 inch casing, alternatively more than 18 sleeve systems within a 4.5 inch casing, alternatively more than 20 sleeve systems within a 4.5 inch casing, or even more sleeve systems. Of course, the number of sleeve systems able to be used within such a wellbore servicing system is generally increased when using such a wellbore servicing system that has a casing size greater than 4.5 inches. It will be appreciated that relatively more sleeve systems may be used in a casing of a particular size as the minimum gap chosen is reduced.

It will be appreciated that in a wellbore servicing system substantially similar to wellbore servicing system 100, a "minimum seal radial distance" may be described as the minimum acceptable radial distance (relative to the seat central axis) over which a sealing contact interface between a seat upper landing surface and a dart landing seat must extend. In some embodiments, the minimum seal radial distance may be within a range of about 0.010 inches to about 0.11 inches, alternatively about 0.020 inches to about 0.10 inches, alternatively about 0.030 inches to about 0.090 inches, alternatively about 0.040 inches to about 0.080 inches, alternatively about 0.050 inches to about 0.070 inches, alternatively about 0.055 inches to about 0.065 inches, alternatively about 0.059 inches to about 0.061 inches. In another embodiment, the minimum seal radial distance may be about 0.060 inches. It will be appreciated that a relatively smaller minimum seal radial distance may be acceptable where components are constructed of materials having relatively higher compressive material strengths. It will be appreciated that relatively more sleeve systems may be used in a casing of a particular size as the minimum seal radial distance chosen is reduced.

EXAMPLES

Example 1

In some embodiments substantially similar to wellbore servicing system 100, some components may comprise the following dimensions (in inches):

| Example reference number | Dimension Description | Sleeve System 200 | Sleeve System 200b | Sleeve System 200a |
|---|---|---|---|---|
| 240 | diameter of inner slide surface | 4.625 | 4.625 | 4.625 |
| 266 | diameter of inner surface of baffle | 3.83 | 3.83 | 3.83 |
| 320 | tool notch depth | 0.2 | N/A | N/A |
| 322 | interior surface length | 1.47 | 1.04 | 1.16 |
| 324 | interior surface diameter | 3.34 | 1.18 | 1.06 |
| 326 | exterior surface length | 1.96 | 5.56 | 5.71 |
| 328 | exterior surface diameter | 3.8 | 3.78 | 3.78 |
| 332 | chamfer angle | 45° | 45° | 45° |
| 338 | lower seat end angle | 45° | N/A | N/A |
| 344 | seat upper landing surface angle | 45° | 20° | 15° |
| 346 | seat upper landing surface base diameter | 3.74 | 3.6 | 3.5 |
| 348 | tool interface surface length | 0.5 | 1.5 | 1.5 |
| 350 | tool notch width | 0.38 | N/A | N/A |
| 352 | tool notch bisection length | 0.19 | N/A | N/A |
| 360 | tool hole diameter | N/A | 0.375 | 0.375 |
| 362 | tool hole pattern diameter | N/A | 3 | 3 |
| 416 | central disc length | 1.01 | 0.75 | 0.74 |
| 422 | central ring diameter | 3.4 | 1.24 | 1.12 |
| 424 | central shelf diameter | 3.325 | 1.165 | N/A |
| 426 | central shelf length | 0.18 | 0.12 | N/A |
| 434 | dart landing seat angle | 45° | 20° | 15° |

-continued

| Example reference number | Dimension Description | Sleeve System 200 | Sleeve System 200b | Sleeve System 200a |
|---|---|---|---|---|
| 436 | central ring length | 0.58 | 0.31 | 0.3 |
| 440 | central shelf chamfer angle | 45° | 45° | N/A |
| 442 | body neck length | 0.12 | 0.12 | 0.12 |
| 444 | body neck diameter | 1.31 | 0.48 | 0.38 |
| 448 | body arm length | 0.75 | 0.58 | 0.58 |
| 450 | body arm minor diameter | 1.31 | 0.48 | 0.38 |
| 456 | body arm inner chamfer angle | 45° | 45° | 45° |
| 458 | body arm outer chamfer angle | 45° | 45° | 45° |
| 460 | dart body length | 2.75 | 2.16 | 2.14 |
| 462 | body arm major diameter | 1.49 | 0.617 | 0.493 |
| 480 | dart nose base diameter | 3.28 | 1.12 | 1 |
| 486 | nose transition angle | 12° | N/A | N/A |
| 488 | dart nose base length | 0.5 | 1.35 | 1.35 |
| 490 | dart nose shelf diameter | 2.62 | 0.75 | 0.75 |
| 492 | dart nose shelf length | 0.63 | 0.75 | 0.75 |
| 494 | centralizer support diameter | 2 | 0.625 | 0.625 |
| 496 | centralizer support length | 0.75 | 0.5 | 0.5 |
| 502 | dart nose tip length | 1.12 | 1 | 1 |
| 506 | dart nose length | 3.5 | 3.6 | 3.6 |
| 510 | countersink major diameter | 1.56 | 0.67 | 0.55 |
| 512 | countersink angle | 45° | 45° | 45° |
| 516 | threaded length | 0.87 | 0.8 | 0.8 |
| 518 | countersunk hole length | 1 | 0.9 | 0.9 |
| 526 | centralizer inner diameter | 1.5 | 0.5 | 0.5 |
| 528 | centralizer outer diameter | 3.75 | 1.5 | 1.5 |
| 530 | centralizer length | 1 | 0.5 | 0.5 |
| 532 | dart length | 8.01 | 7.96 | 7.94 |

Example 2

In some embodiments substantially similar to wellbore servicing system 100, component materials may be selected as follows. Seats 300, 300*b*, and 300*a* may be constructed of cast iron. Dart body 402 may be constructed of cast iron while dart bodies 402*b*, 402*a* may be constructed of High-Temperature Garolite (G-11 Epoxy Grade). Dart noses 404, 404*b*, and 404*a* may be constructed of High-Temperature Garolite (G-11 Epoxy Grade). Dart centralizers 405, 405*b*, and 405*a* may be constructed of foam.

Example 3

In some embodiments substantially similar to wellbore servicing system 100, a plurality of sleeve systems may comprise seat and darts comprising the following dimensions:

| Order of increasing uphole location within wellbore | Seat Passage Inside Diameter (also referred to as seat inside surface diameter (in) | Dart Outside Diameter (also referred to as central ring diameter (in) |
|---|---|---|
| 1 | 1.06 | 1.12 |
| 2 | 1.18 | 1.24 |
| 3 | 1.3 | 1.36 |
| 4 | 1.42 | 1.48 |
| 5 | 1.54 | 1.6 |
| 6 | 1.66 | 1.72 |
| 7 | 1.78 | 1.84 |
| 8 | 1.9 | 1.96 |
| 9 | 2.02 | 2.08 |
| 10 | 2.14 | 2.2 |
| 11 | 2.26 | 2.32 |
| 12 | 2.38 | 2.44 |
| 13 | 2.5 | 2.56 |
| 14 | 2.62 | 2.68 |
| 15 | 2.74 | 2.8 |

-continued

| Order of increasing uphole location within wellbore | Seat Passage Inside Diameter (also referred to as seat inside surface diameter (in) | Dart Outside Diameter (also referred to as central ring diameter (in) |
|---|---|---|
| 16 | 2.86 | 2.92 |
| 17 | 2.98 | 3.04 |
| 18 | 3.1 | 3.16 |
| 19 | 3.22 | 3.28 |
| 20 | 3.34 | 3.4 |

It will be appreciated that the above-described system may be referred to as comprising a maximum adjacent seat resolution of 0.120 inches since successive uphole seats comprise a seat passage inside diameter that is 0.120 inches larger than the next adjacent downhole seat. Specifically, for example, according to the chart above the seat located most downhole comprises a seat passage inside diameter of 1.06 inches while the next adjacent uphole seat comprises a seat passage inside diameter of 1.120 inches. It will be appreciated that in the sleeve systems described above, such as sleeve system 200, a maximum adjacent seat resolution of 0.120 inches corresponds to the provision of a 0.060 inch minimum gap between the seat passage inner diameter and the dart outside diameter while also providing for a minimum seal radial distance of 0.060 inches.

Example 4

It will be appreciated in some embodiments of a wellbore servicing system such as wellbore servicing system 100, material selection for various components of the sleeve systems may be made in relation to anticipated pressures and related anticipated forces to be exerted on the components of the sleeve systems. The table below indicates that as the seat passage diameter of a sleeve system is increased, an accompanying anticipated force exerted on the components of the sleeve system also increases.

| Seat passage diameter (in) | Dart landing seat surface area (in^2) | Down force (lbf) @ 7,500 psi (applied uphole of the dart) | Stress on dart landing seat surface @ 7500 psi (lbf/in^2) | % increase of stress on dart landing seat surface (relative to the down force associated with seat passage diameter of 1.06 inches) |
|---|---|---|---|---|
| 1.06 | 0.108 | 8146 | 75674 | 0 |
| 1.18 | 0.119 | 9887 | 83169 | 10 |
| 1.3 | 0.130 | 11796 | 90665 | 20 |
| 1.42 | 0.141 | 13874 | 98162 | 30 |
| 1.54 | 0.153 | 16120 | 105660 | 40 |
| 1.66 | 0.164 | 18535 | 113157 | 50 |
| 1.78 | 0.175 | 21119 | 120655 | 59 |
| 1.9 | 0.186 | 23870 | 128153 | 69 |
| 2.02 | 0.197 | 26791 | 135652 | 79 |
| 2.14 | 0.209 | 29879 | 143150 | 89 |
| 2.26 | 0.220 | 33137 | 150649 | 99 |
| 2.38 | 0.231 | 36563 | 158148 | 109 |
| 2.5 | 0.242 | 40157 | 165647 | 119 |
| 2.62 | 0.254 | 43919 | 173146 | 129 |
| 2.74 | 0.265 | 47851 | 180645 | 139 |
| 2.86 | 0.276 | 51950 | 188144 | 149 |
| 2.98 | 0.287 | 56219 | 195643 | 159 |
| 3.1 | 0.299 | 60655 | 203143 | 168 |
| 3.22 | 0.310 | 65260 | 210642 | 178 |
| 3.34 | 0.321 | 70034 | 218141 | 188 |

While the above table is calculated assuming 90 degree dart seat landing angles, the table nonetheless illustrates that anticipated stresses increase as seat/dart sizes increase. Accordingly, materials having relatively higher compressive strengths, in some embodiments, may be used for constructing seats and/or darts having relatively larger sizes. For example, a smaller dart body of a dart may comprise a composite material that forms a dart landing surface of the smaller dart while cast iron may be used to form a dart landing surface of a relative larger dart. Similarly, a smaller upper seat landing surface of a smaller seat may comprise a composite material while cast iron may be used to form an upper seat landing surface of a relative larger seat.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A wellbore servicing system, comprising:

a plurality of sleeve systems disposed in a wellbore, each sleeve system comprising a seat and a dart configured to selectively seal against the seat to the exclusion of other seats, the seats each comprising an upper seat landing surface and the darts each comprising a dart landing surface;

wherein the darts each comprise a dart landing surface that is configured to complement an upper seat landing surface of the seat to which the dart is configured to selectively seal against;

wherein a first seat of the plurality of seats is disposed within the wellbore downhole relative to a second seat of the plurality of seats; and wherein a first upper seat landing surface of the first seat comprises a first upper seat landing surface angle that is smaller than a second upper seat landing surface angle of a second upper seat landing surface of the second seat.

2. The wellbore servicing system according to claim 1, wherein the dart landing surface that is configured to complement an upper seat landing surface of the seat to which the dart is configured to selectively seal against comprises a dart landing surface angle that complements an upper seat landing surface angle of the upper seat landing surface.

3. The wellbore servicing system according to claim 1, wherein the dart landing surface that is configured to complement an upper seat landing surface is at least partially configured to have a substantially frusto-conical shape.

4. A wellbore servicing system, comprising:

a first sleeve system disposed in a wellbore, the first sleeve system, comprising a first seat landing surface;

a second sleeve system disposed in the wellbore and uphole of the first sleeve system, the second sleeve system comprising a second seat landing surface; and a dart;

wherein the first seat landing surface and the second seat landing surface are each at least partially frusto-conical in shape;

wherein a first seat landing surface angle of the first seat landing surface is less than a second seat landing surface angle of the second seat landing surface;

wherein at least one of the first seat and the second seat are configured to sealing engage the dart; and p1 wherein the dart comprises a dart landing seat angle smaller than the second seat landing surface angle and wherein the dart landing seat angle is substantially the same as the first seat landing surface angle.

5. The wellbore servicing system according to claim 4, wherein the dart comprises a dart outer diameter smaller than a second seat passage diameter of the second seat and wherein the dart outer diameter is larger than a first seat passage diameter of the first seat.

6. The wellbore servicing system according to claim 4, wherein a minimum gap is provided between a second seat passage diameter and a dart outer diameter.

7. The wellbore servicing system according to claim 6, wherein the minimum gap is within a range of about 0.030 inches and about 0.090 inches.

8. The wellbore servicing system according to claim claim 4, wherein at least 8 seats are disposed in a work string comprising about a 4.5 inch casing.

9. A wellbore servicing system, comprising:

a plurality of sleeve systems disposed in a wellbore, each sleeve system comprising a seat and a dart configured to selectively seal against the seat to the exclusion of other seats, the seats each comprising an upper seat landing surface and the darts each comprising a dart landing surface;

wherein each of the seat landing surfaces and each of the dart landing surfaces are at least partially substantially frusto-conical in shape; and wherein a first seat comprises a smaller seat landing surface angle as compared to a seat landing surface angle of a second seat that is located uphole relative to the first seat.

10. The wellbore servicing system according to claim 9, wherein at least 8 seats are disposed in a work string comprising about a 4.5 inch casing.

11. The wellbore servicing system according to claim 9, wherein darts and seats that are configured to seal against each other are configured to comprise complementary dart landing surface angles and upper seal landing surface angles, respectively.

12. A method of servicing a wellbore, comprising:

disposing a first seat within a wellbore and disposing a second seat within the wellbore and uphole of the first seat, the first seat and the second seat comprising a first seat landing surface and a second seat landing surface, respectively;

passing a first dart through a second passage of the second seat; and contacting the first dart with the first seat landing surface;

wherein the first seat landing surface and second seat landing surface are at least partially frusto-conical in shape and wherein the first dart complements the first seat landing surface but does not complement the second seat landing surface; and wherein a second seat landing surface angle of the second seat landing surface is greater than a first seat landing surface angle of the first seat landing surface.

13. The method of claim 12, wherein the first seat is coupled to a first sliding sleeve and the first sliding sleeve is shifted to an open position via contact of the first seat and the first dart, thereby revealing a plurality of ports in fluid communication with a surrounding formation; and further comprising: flowing a wellbore servicing fluid down the wellbore, through the plurality of ports, and into the surrounding formation, wherein the wellbore servicing fluid is a fracturing fluid and the surrounding formation is fractured.

14. The method according to claim 13, further comprising:

degrading at least a portion of at least one of the first seat, the first dart, or both.

15. The method according to claim 14, further comprising:

backflowing at least a portion of the wellbore so that any remaining portions of the first dart and any remaining portions of the first seat may be removed from the wellbore.

16. The wellbore servicing system according to claim 1, wherein at least 8 seats are disposed in a work string comprising about a 4.5 inch casing.

17. The method according to claim 9, wherein at least 8 seats are disposed in a work string comprising about a 4.5 inch casing.

18. The wellbore servicing system according to claim 1, wherein a minimum gap is provided between a second seat passage diameter and a dart outer diameter.

19. The wellbore servicing system according to claim 18, wherein the minimum gap is within a range of about 0.030 inches and about 0.090 inches.

20. The method according to claim 9, wherein a minimum gap is provided between a second seat passage diameter and a dart outer diameter.

21. The wellbore servicing system according to claim 20, wherein the minimum gap is within a range of about 0.030 inches and about 0.090 inches.

* * * * *